US010052545B2

(12) United States Patent
Goldwitz

(10) Patent No.: US 10,052,545 B2
(45) **Date of Patent: *Aug. 21, 2018**

(54) FOLDABLE SPORT GOALS AND THROWBACK DEVICES

(71) Applicant: NEW ENGLAND OUTDOOR & RECREATIONAL PRODUCTS, LLC, West Haven, CT (US)

(72) Inventor: Brian Goldwitz, West Haven, CT (US)

(73) Assignee: New England Outdoor & Recreational Products, LLC, West Haven, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/089,698

(22) Filed: Nov. 25, 2013

(65) Prior Publication Data

US 2014/0155197 A1 Jun. 5, 2014

Related U.S. Application Data

(62) Division of application No. 12/619,669, filed on Nov. 16, 2009, now Pat. No. 8,590,901.

(Continued)

(51) Int. Cl.

| | |
|---|---|
| ***A63B 63/00*** | (2006.01) |
| ***A63B 71/02*** | (2006.01) |
| ***A63B 69/00*** | (2006.01) |

(52) U.S. Cl.

CPC ..... *A63B 71/023* (2013.01); *A63B 63/00* (2013.01); *A63B 63/004* (2013.01); *A63B 69/0097* (2013.01); *A63B 2063/002* (2013.01); *A63B 2063/005* (2013.01); *A63B 2210/50* (2013.01); *A63B 2225/09* (2013.01)

(58) Field of Classification Search

CPC . A63B 69/0097; A63B 2210/50; A63B 63/00; A63B 2069/0006

USPC ..... 473/434, 435, 454, 476–478; 273/395, 273/396, 398–402

See application file for complete search history.

(56) References Cited

U.S. PATENT DOCUMENTS 3,427,026 A * 2/1969 Mahoney ..... 473/435
3,836,144 A * 9/1974 Mahoney ..... 473/435

(Continued)

OTHER PUBLICATIONS

PCT/US2009/064660. International Search Report and Written Opinion (dated Jul. 22, 2010).

(Continued)

*Primary Examiner* — Mark Graham

(74) *Attorney, Agent, or Firm* — Loza & Loza, LLP; Julio Loza

(57) ABSTRACT

One embodiment provides a foldable throwback device comprising a front frame, a base frame, and telescoping angle members. The front frame is adapted to secure a bounce-back surface and is foldable into at least three sections without removal of the bounce-back surface. The base frame is coupled to the front frame by hinge brackets that allow the base frame to fold substantially flat onto the front frame without significant disassembly. Each telescoping angle member extends from the base frame to the front frame, and is adjustable to allow angling the front frame relative to the base frame. Each telescoping angle member may include a rotation-limiting mechanism and a safety mechanism that prevents unintentional detachment.

12 Claims, 41 Drawing Sheets

Related U.S. Application Data

(60) Provisional application No. 61/115,108, filed on Nov. 16, 2008.

(56) References Cited

U.S. PATENT DOCUMENTS

| | | | | | |
|---|---|---|---|---|---|
| 4,239,235 | A * | 12/1980 | Torres | ..... | 473/434 |
| 4,456,251 | A * | 6/1984 | Balaz | ..... | 473/435 |
| 4,489,941 | A * | 12/1984 | Shieh | ..... | 473/197 |
| 4,553,751 | A * | 11/1985 | Ketchum | ..... | 473/435 |
| 5,772,537 | A * | 6/1998 | Anderson et al. | ..... | 473/435 |
| 5,807,193 | A * | 9/1998 | Talarico et al. | ..... | 473/421 |
| 5,833,234 | A * | 11/1998 | Vavala et al. | ..... | 473/434 |
| 6,165,085 | A * | 12/2000 | Lubin | ..... | 473/478 |
| 6,739,988 | B2 * | 5/2004 | Jensen et al. | ..... | 473/435 |
| 6,979,274 | B1 | 12/2005 | Raber | | |
| 8,590,901 | B2 * | 11/2013 | Goldwitz | ..... | 273/395 |
| 2003/0060309 | A1 * | 3/2003 | Smith, IV | ..... | 473/431 |
| 2003/0236139 | A1 * | 12/2003 | Jensen et al. | ..... | 473/434 |
| 2004/0140621 | A1 * | 7/2004 | Liao | ..... | 273/396 |
| 2007/0090601 | A1 * | 4/2007 | Liao | ..... | 273/396 |
| 2008/0067751 | A1 * | 3/2008 | Hunt | ..... | 273/396 |

OTHER PUBLICATIONS

PCT/US2009/064660. International Preliminary Report on Patentability (dated May 17, 2011).

* cited by examiner

FOLDABLE SPORT GOALS AND THROWBACK DEVICES

CLAIM OF PRIORITY

This application claims the benefit of U.S. Utility application Ser. No. 12/619,669, entitled "Foldable Sports Goals and Throwback Devices" filed on Nov. 16, 2009 which claims priority on Provisional Application No. 61/115,108, entitled "Goal and Throwback Device" filed Nov. 16, 2008, and both are hereby incorporated by reference.

FIELD OF INVENTION

The present invention relates to collapsible/folding sport goals and a throwback devices.

BACKGROUND OF INVENTION

In many sports, it is often desirable to practice with a throwback device that stops and/or returns a thrown ball. Additionally, oftentimes it is desirable to also have a sport goal with which to play a game. However, these devices tend to take up considerable space when in use. Therefore, it would be desirable to have a throwback and/or sport goal device that can be collapsed and/or folded into a compact unit when not in use or when it is stored.

SUMMARY OF INVENTION

A first embodiment provides foldable throwback device comprising a front frame, a base frame, and first and second telescoping angle members. The front frame may be adapted to secure a bounce-back surface and may be foldable into at least three sections without removal of the bounce-back surface. The base frame is coupled to the front frame by hinge brackets that allow the base frame to fold onto the front frame. The first and second telescoping angle members each extend from the base frame to the front frame. The first and second telescoping angle members are adjustable to allow angling the front frame relative to the base frame. The front frame may include at least two upright members, each upright member having at least a first hinge and a second hinge that allow the front frame to fold into the three sections. The first hinge may be located higher than the second hinge on an upright member, the second hinge is also coupled to a first end of the first telescoping angle member. The front frame is foldable while the bound-back surface is under tension. The bounce-back may be secured on all sides of the front frame by a plurality of springs. Each of the first and second telescoping angle members may be detachable from the base frame and attachable to its respective hinge bracket for folding the throwback device. The first and second telescoping angle members are folded between at least two sections of the front frame. Each of the telescoping angle members may include an inner telescoping member, an outer telescoping member, and a stub, the stub coupled to the front frame, the inner telescoping member coupled to the base frame, and the outer telescoping member rotates relative to the stub and inner telescoping member. The outer telescoping member may also include a row of a plurality of openings along its length, the inner telescoping member includes a push button that engages one of the openings to secure the inner telescoping member to the outer telescoping member. The outer telescoping member is rotatable relative to the inner telescoping member to change the length of the angle member. The stub may include a pin that engages a rotation-limiting slot at a first end of the outer telescoping member to limit the rotation of the outer telescoping member relative to the inner telescoping member. The outer telescoping member may also include at least one safety slot at a second end to prevent the inner telescoping member from becoming disengaged, the safety slot sized to catch the push button whether the outer telescoping member is rotated or not.

A second embodiment provides a throwback and sport goal combination device comprising a front frame, a base frame, and first and second telescoping angle members. The front frame is adapted to secure one of either a bounce-back surface or a sport goal net, the front frame foldable into at least two sections. The base frame coupled to the front frame by hinge brackets that allow the base frame to fold onto the front frame. Each of the first and second telescoping angle members extend from the base frame to the front frame. The first and second telescoping angle members are adjustable to allow angling the front frame relative to the base frame. The base frame may include a first and second horizontal members attached to each other at one end and to the hinge brackets at an opposite end. The front frame includes a bottom member that is attachable when the combination device is used as a throwback device and removable when the combination device is used as a sport goal. Each of the telescoping angle members may include an inner telescoping member, an outer telescoping member, and a stub. The stub may be coupled to the front frame. The inner telescoping member may be coupled to the base frame. The outer telescoping member rotates relative to the stub and inner telescoping member to change the length of the angle member. The first and second telescoping angle members are detachable from the base frame and attachable to their respective hinge bracket. The base frame is then foldable toward the front frame to make the combination device substantially flat.

A third embodiment provides a throwback and sport goal combination device comprising a front frame, a base frame, and first and second angle members. The front frame is adapted to secure either a bounce-back surface or a sport goal net. The front frame is foldable into at least two sections. The base frame is coupled to the front frame by hinge brackets that allow the base frame to fold onto the front frame. Each of the first and second angle members extending from the base frame to the front frame. The angle members comprising at least a first section and a second section at an angle to each other. The front frame includes upright members, where each upright member includes a first, second and third segment. Each of the first and second angle members coupled to a second segment in a corresponding upright member and the second segment can be rotated relative to the first and third segments. Each of the first and second angle members is detachable from the base frame. The second segments are then rotated to rotate the position of the first and second angle members. The detached ends of the first and second angle members are then coupled to respective upright members of the front frame to facilitate folding of the base frame onto the front frame.

DETAILED DESCRIPTION

The following detailed description is of the best currently contemplated modes of carrying out the present invention. The description is not to be taken in a limiting sense, but is made merely for the purpose of illustrating the general principles of the invention.

Various features of the present invention will be better understood from the following detailed description of an exemplary embodiment of the invention, taken in conjunction with the accompanying drawings.

A first feature relates to a collapsible and/or folding throwback device that can be angled along a wide range and can be efficiently folded into a substantially flat configuration for storage.

A second feature provides a twist-and-lock telescoping mechanism adapted to prevent accidental disengagement.

A third feature provides a throwback and sport goal combination device that can also be efficiently folded into a substantially flat configuration for storage.

Exemplary Throwback Device

Figure 1:
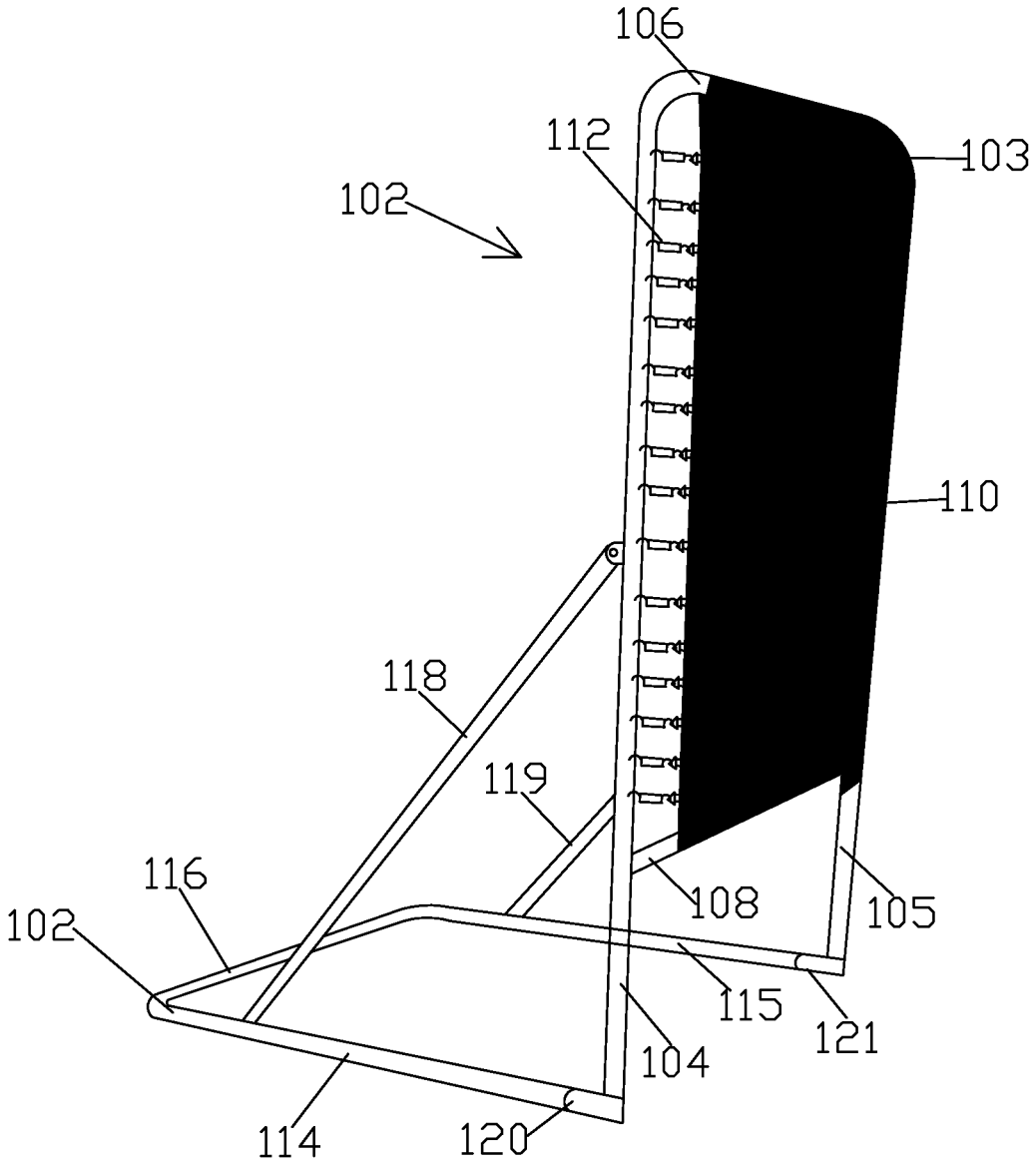
FIG. 1 illustrates an upright throwback device.

FIG. 1 illustrates an upright throwback device. The throwback device 102 a front frame 103 that includes a first upright member 104 and a second upright member 105 coupled to a first transverse member 106 and a second transverse member 108. In this example, the first transverse member 106 is coupled at a first end of the upright members 104 and 105 while the second transverse member 108 is coupled a distance from an opposite second end of the upright members 104 and 105. An internal area of the front frame 103, defined by the upright members 104 and 105 and transverse members 106 and 108, serves to hold a bounce-back surface 110. In this example, the bounce-back surface 110 may be held along its perimeter by a plurality of springs 112 to the upright members 104 and 105 and transverse members 106 and 108. The bounce-back surface 110 may be elastic to allow bouncing of a ball thrown to it or it may be non-elastic, relying on the springs 112 for tension.

The throwback device 102 may be kept upright by a base frame 105 that includes two horizontal feet 114 and 115 and a transverse foot 116. First ends of the two horizontal feet 114 and 115, respectively, are coupled to the second end of the upright members 104 and 105, respectively. The transverse foot 116 is coupled between the two horizontal feet 114 and 115 at an opposite second end of the horizontal feet 114 and 115. Note that the two horizontal feet 114 and 115 may be coupled to the second end of the upright members 104 and 105, respectively, by use of hinge mechanisms 120 and 121, respectively. Telescoping and adjustable angle members 118 and 119 may be coupled to both the horizontal feet 114 and 115, respectively, and the upright members 104 and 105, respectively. In one example, first ends of the angle members 118 and 119, respectively, may be coupled between the first and second ends of the upright members 104 and 105, respectively. Second ends of the angle members 118 and 119 may be coupled between the first and second ends of the horizontal feet 114 and 115, respectively.

Figure 2:
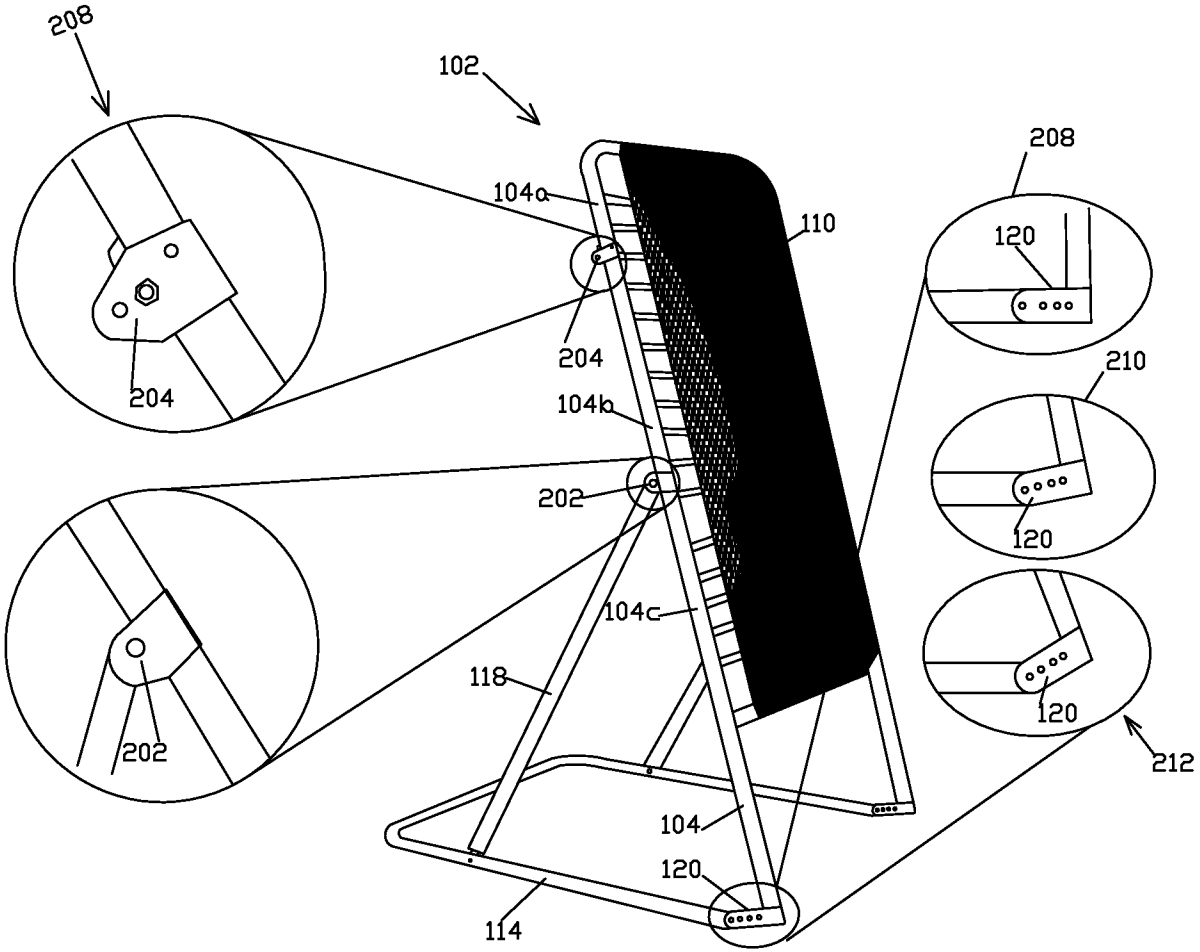
FIG. 2 illustrates how the throwback device may be placed in an angled position.

FIG. 2 illustrates how the throwback device may be placed in an angled position. As illustrated, the upright member 104 may include three segments 104*a*, 104*b*, and 104*c* that are hingedly coupled together. A first segment 104*a* and a second segment 104*b* may be coupled by a first hinge 204 that allows folding of the throwback device without loosening the tension on the bounce-back surface 110 or removing the bounce-back surface 110. Additionally the second segment 104*b* and a third segment 104*c* may be coupled by a second hinge 202 that also allows folding of the throwback device without loosening the tension on the bounce-back surface 110 or removing the bounce-back surface 110.

Also shown here are various positions 208, 210 and 212 of the hinge mechanism 120 that allows the bounce-back surface 110 to be angled relative to the ground or the base.

Figure 3:
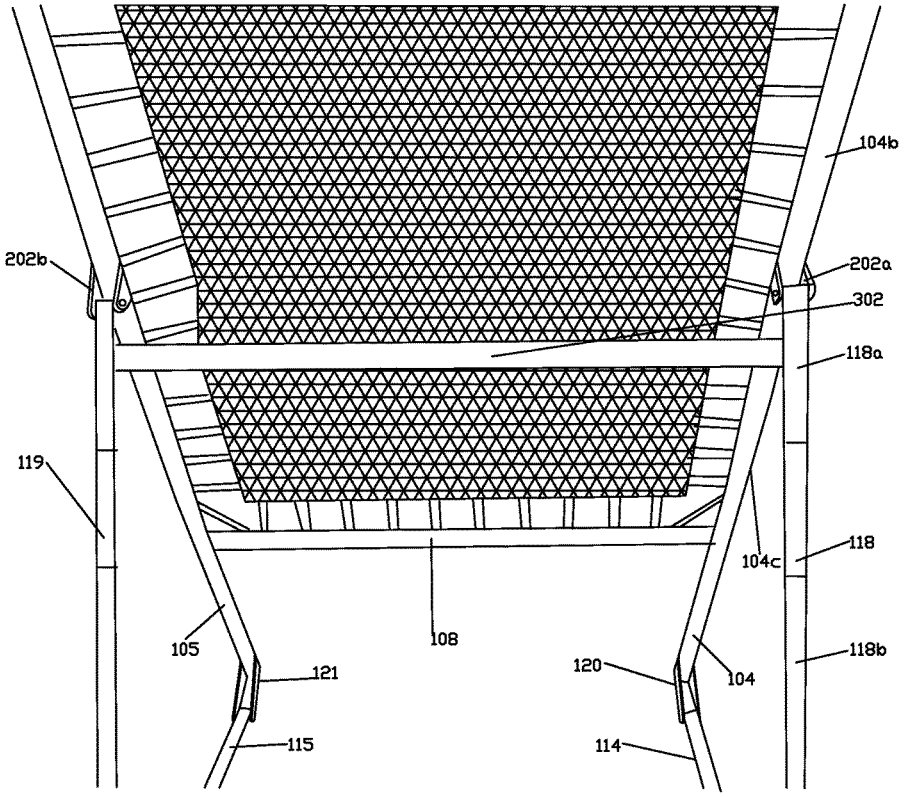
FIG. 3 illustrates a back view of the throwback device.

FIG. 3 illustrates a back view of the throwback device. A horizontal bar 302 extends between the first ends of the angle members 118 and 119, respectively. In one example, the angled members 118 and 119 may include a first segment 118*a*, a second segment 118*b*, and a third segment (not illustrated).

Figure 4:
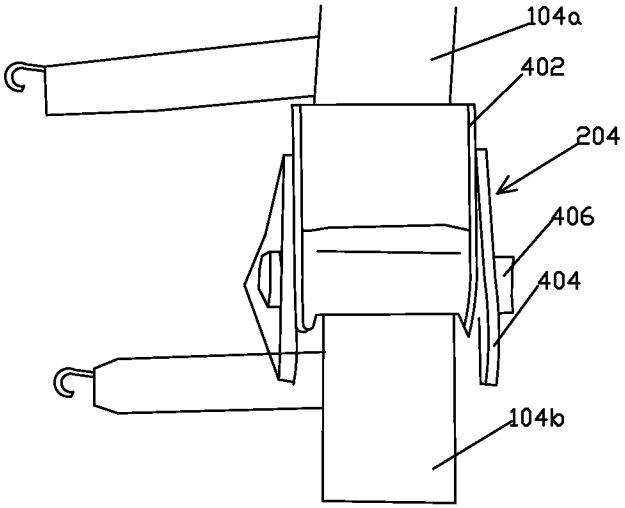
FIG. 4 is a close-up view of the first hinge that allows folding of the throwback device.

FIG. 4 is a close-up view of the first hinge 204 that allows folding of the throwback device. The first hinge 204 includes a first bracket 402 coupled to the first segment 104*a* of the upright member 104 and a second bracket 404 coupled to the second segment 104*b* of the upright member 104. The first and second brackets 402 and 404 may include an opening through which a pivoting pin 406 passes. Note that the pivoting pin 406 and pivoting point of the first hinge 204 is located on the back of the throwback device 102.

Figure 5:
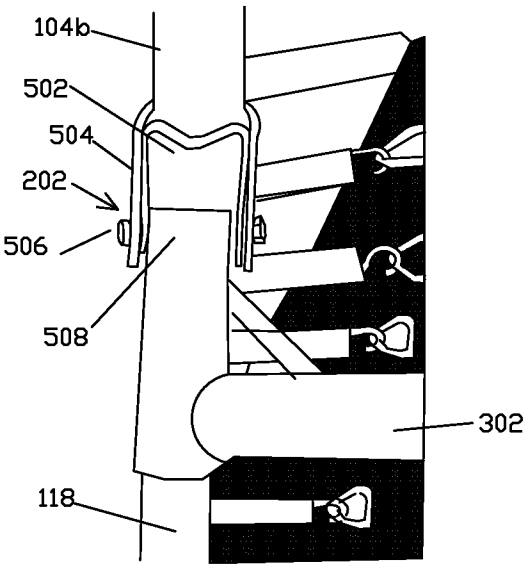
FIG. 5 is a close-up view of the second hinge that allows folding of the throwback device.

FIG. 5 is a close-up view of the second hinge 202 that allows folding of the throwback device. The second hinge 202 includes a first bracket 502 coupled to the second segment 104*b* of the upright member 104 and a second bracket 504 coupled to the third segment 104*c* of the upright member 104. The first and second brackets 502 and 504 may include an opening through which a pivoting pin 506 passes. Additionally, the first end of the angle member 118 may include an opening through which the pivoting pin 506 passes. Therefore, as the length of the angle member 118 is adjusted to change the angle of the bounce-back surface 110, the first end of the angle member 118 pivots about the pivoting pin 506. When folded, second segment 104*b* folds onto the third segment 104*c* (not illustrated here).

Figure 6:
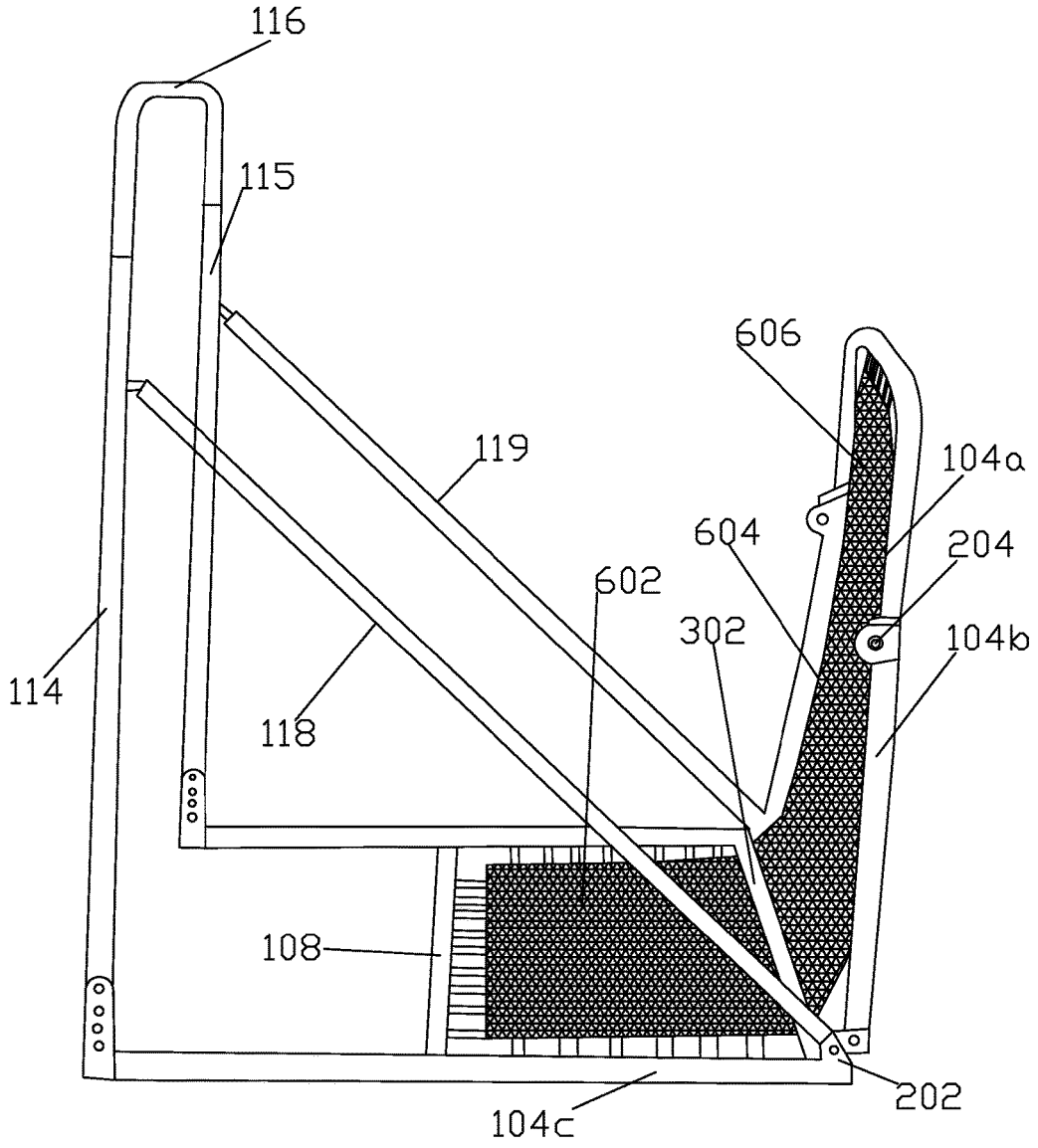
FIGS. 6-7 illustrate how the throwback device may be partially folded.
Figure 7:
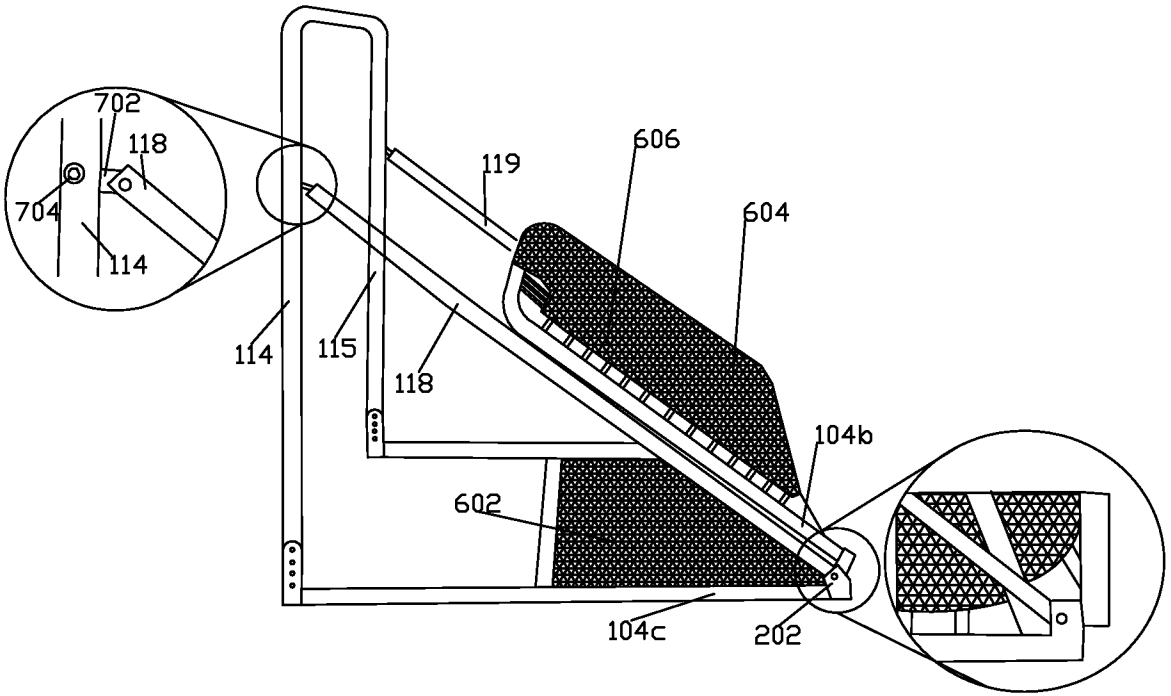

FIGS. 6-7 illustrate how the throwback device may be partially folded. The front frame 103 and bounce-back surface 110 may be described as including a first section 602, a second section 604, and a third section 606. In this example, the second and third sections 604 and 606 fold together along the second hinge 202. Once partially folded, the angle members 118 and 119 may be removed or partially detached from the horizontal feet 114 and 115, respectively. An insert tab 702 is pivotally coupled to the second end of the angle members 118 and 119. The insert tab 702 is received in a slot in the horizontal foot 114 and a pull pin 704 is used to couple the insert tab 702 within the slot.

Figure 8:
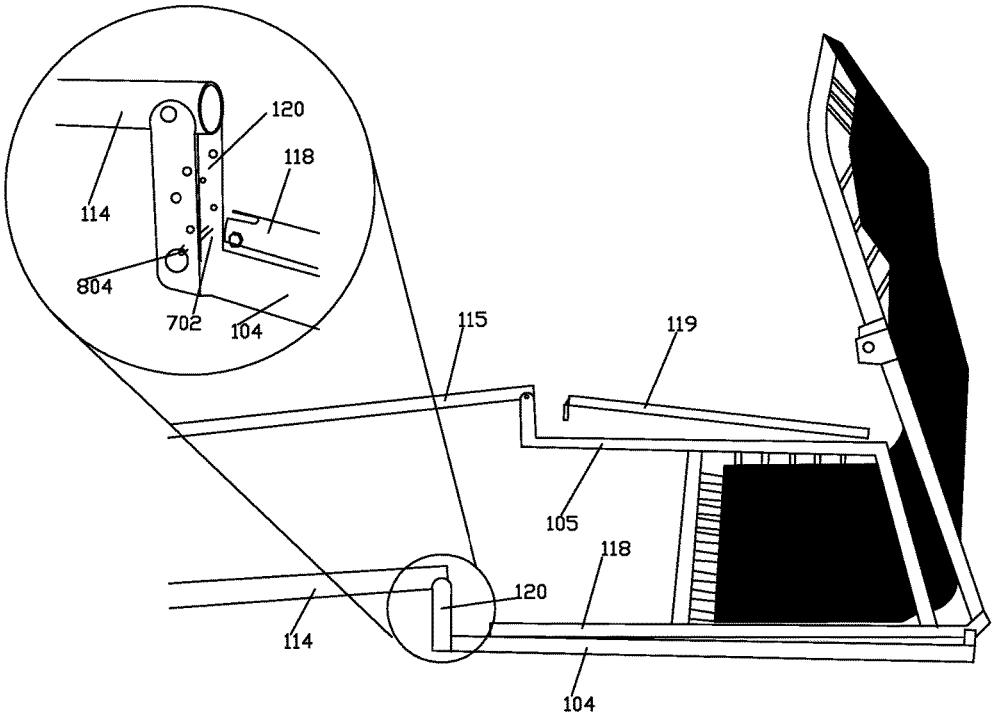
FIG. 8 illustrates how the horizontal feet are detached from the angle members.

FIG. 8 illustrates how the horizontal feet 114 and 115 are detached from the angle members 118 and 119, respectively. Once detached, the angle members 118/119 may be coupled to their respective hinge bracket 120 by using an insert tab 702 and a pull pin 804 that passes through the hinge bracket 120 and the insert tab 702. In this manner, the angle members 118 and 119 may be held between two sections of the front frame 103.

Figure 9:
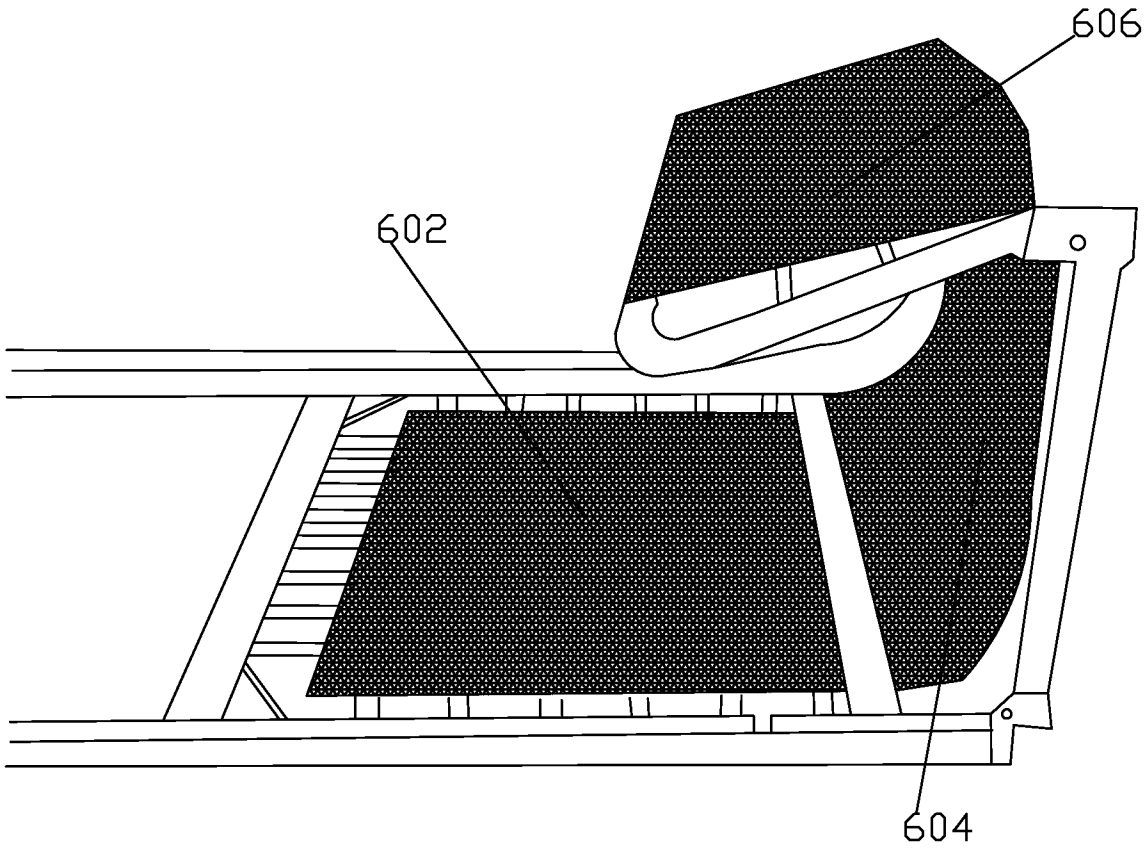
FIG. 9 illustrates how the third section may be folded onto the second section as the second section is being folded into the first section.

FIG. 9 illustrates how the third section 606 may be folded onto the second section 604 as the second section is being folded into the first section 602. In this manner, the third section 606 lies between the second section 606 and the first section 602.

Figure 10:
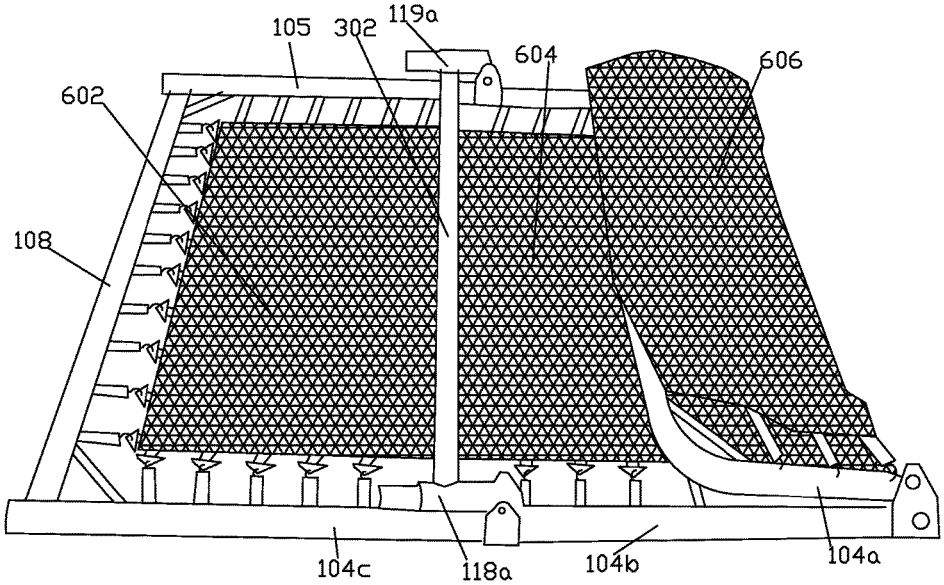
FIG. 10 illustrates how the third section may be fully folded onto the second section.

FIG. 10 illustrates how the third section 606 may be fully folded onto the second section 604. In this example, the angle members and part of the upright supports have been removed (e.g., for storage and/or shipping). In this view, the second section 604 has not yet been folded onto the first section 602.

Figure 11:
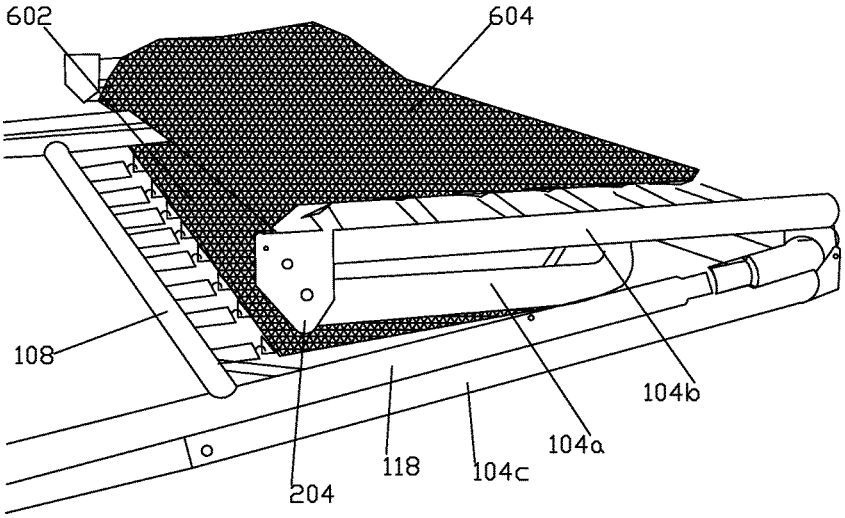
FIG. 11 illustrates how the second section may be fully folded onto the first section thereby making the throwback device into a compact configuration.

FIG. 11 illustrates how the second section 604 may be fully folded onto the first section 602 thereby making the throwback device into a compact configuration.

Figure 13:
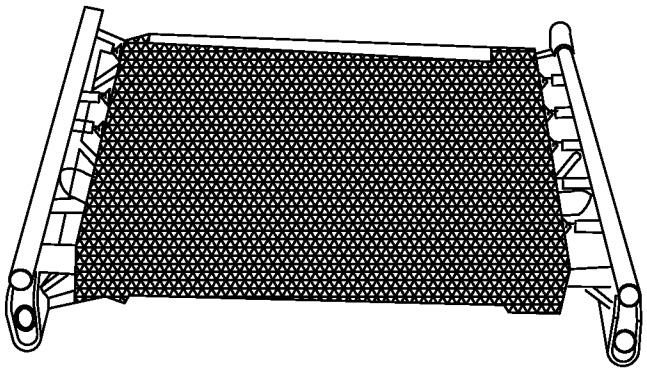
FIGS. 12 and 13 illustrate the fully folded throwback device with part of the upright members, part of the angled members, and the base members removed.
Figure 12:
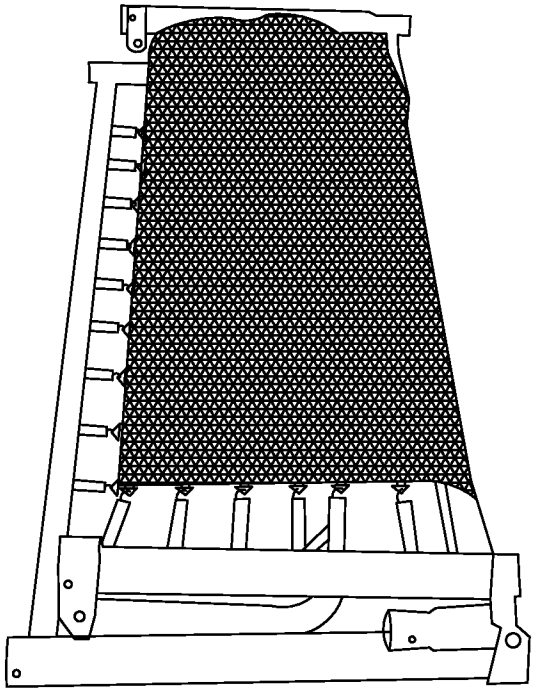

FIGS. 12 and 13 illustrate the fully folded throwback device with part of the upright members, part of the angled members, and the base members removed.

Figure 14:
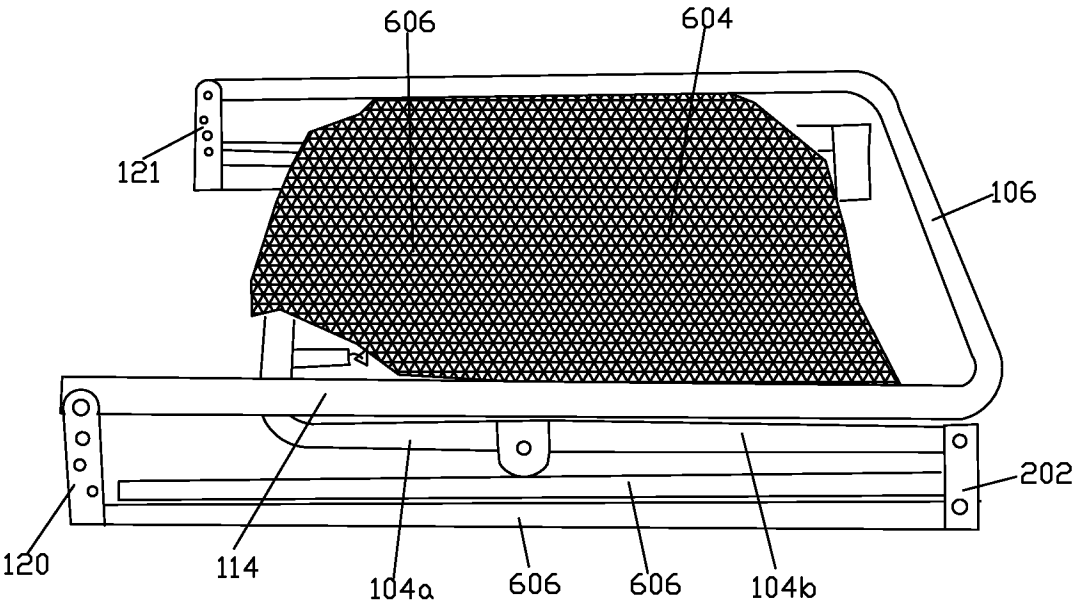
FIG. 14 illustrates the fully folded throwback device but with the third section unfolded.

FIG. 14 illustrates the fully folded throwback device but with the third section 606 unfolded.

Figure 16:
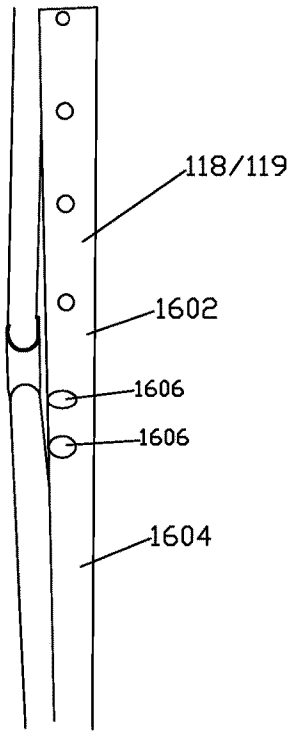
FIGS. 15 and 16 illustrate a view of the angle members according to one example.
Figure 15:
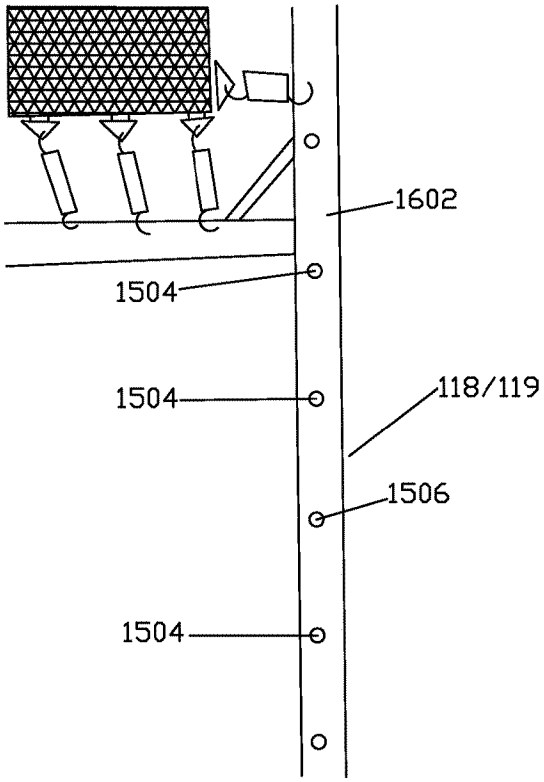

FIGS. 15 and 16 illustrate a view of the angle members 118/119 according to one example. In order to allow the throwback device 102 to be placed at various angles during use, the angle members 118/119 may be adjustable and/or telescoping. Consequently, each angle member 118/119 may include a mechanism that allows its length to be easily (e.g., manually) adjustable).

In one example, each of the angle members 118/119 includes an inner telescoping member 1604 and an outer telescoping member 1602. The outer telescoping member 1602 may include a plurality of opening or holes 1504 along a row. The inner telescoping member 1604 may include a push button 1506 that is fitted to extend through one of the holes 1504, thereby locking the movement of the inner telescoping member 1604 relative to the outer telescoping member 1602. The push button 1506 may be depressed and the inner telescoping member 1604 can be slid relative to the outer telescoping member 1602 to increase or decrease the length of the angle members 118/119. Once the desired length is reached, the push button 1506 is aligned with the closest hole 1504 and it pushes through such hole to lock the length. The outer telescoping member 1602 may also include one or more removal prevention slots 1606 that catch the push button 1506 prior to the inner telescoping member 1604 disengaging from the outer telescoping member 1602. This prevents the unintentional removal of the inner telescoping member 1604 from the outer telescoping member 1602 when they are slid relative to each other (e.g., to extend the length of the angle member 118/119).

However, one problem with such mechanism is how to prevent the inner telescoping member 1604 from unintentionally disengaging from the outer telescoping member 1602. Another problem with this mechanism is how to allow extending or collapsing the telescoping angle members 118/119 without the push pin 1506 engaging each and every hole 1504 along the way.

Figure 17:
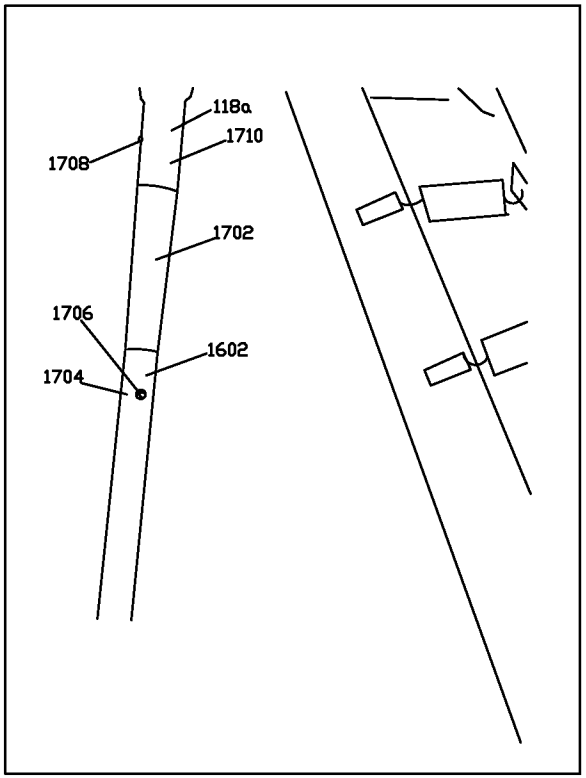
FIG. 17 illustrates a view of the angle member with a twist limiting mechanism.

FIG. 17 illustrates a view of the angle member 118 with a twist limiting mechanism. The outer telescoping member 1602 is inserted into a removable stub 1702. The removable stub 1702 is attached to a receiving stub 1710 at the first segment 118*a* of the angled member 118 by a pull pin, push button 1708, or similar fastener. This push button 1708 prevents the rotation and/or movement of the removable stub 1702 relative to the receiving stub 1710. The outer telescoping member 1602 also includes a rotation-limiting slot 1704 that receives a push button 1706 or pin at one end of the removable stub 1702. In this view, the push button 1706 is located at a first end of the rotation-limiting slot 1704.

Figure 18:
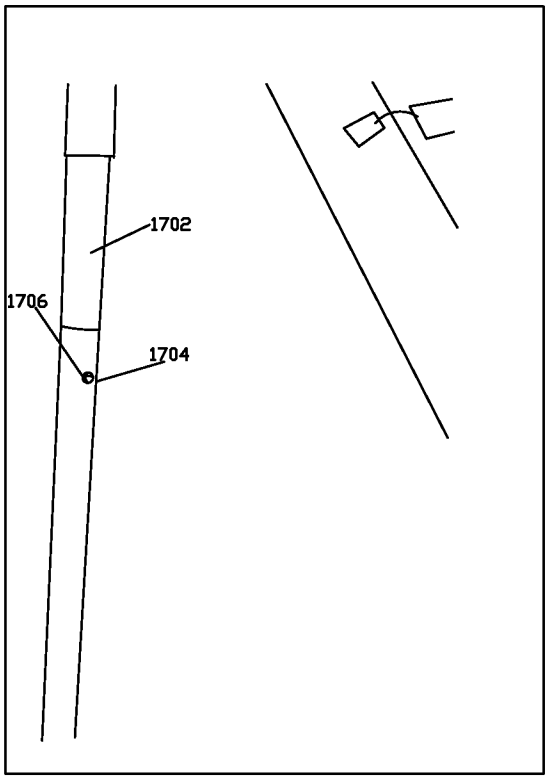
FIG. 18 illustrates how the outer telescoping member rotates relative to the removable stub so that the push button is located at a second end of the rotation-limiting slot.

FIG. 18 illustrates how the outer telescoping member 1602 rotates relative to the removable stub 1702 so that the push button 1706 is located at a second end of the rotation-limiting slot 1704.

Figure 19A:
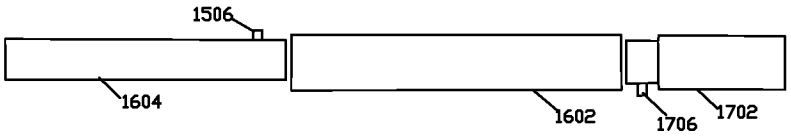
FIGS. 19A-19E illustrate an exploded view of the angle member according to one example.
Figure 19B:
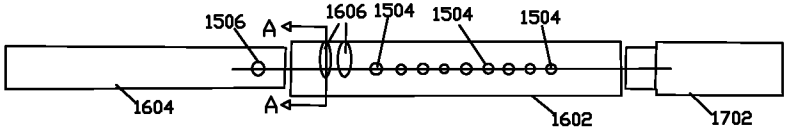
Figure 19C:
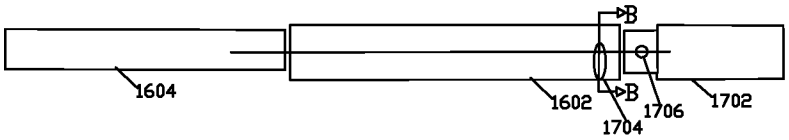
Figure 19D:
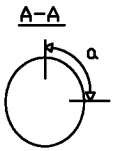
Figure 19E:
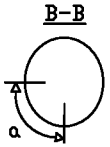

FIGS. 19A-19E illustrate an exploded view of the angle member according to one example. The angle member 118/119 comprises the inner telescoping member 1604, the outer telescoping member 1602, and the removable stub 1702. FIG. 19A illustrates how the push button 1506 is located along an opposite side than the push button 1706. However, in various implementations, the push button 1506 may be located on the same side as the push button 1706 or angled to each other. Note that the one or more removal prevention slots 1606 allows an angular rotation α which coincides with the angular rotation α allowed by the rotation-limiting slot 1704. Note that the push button 1706 and the rotation-limiting slot 1704 are configured so as to prevent the outer telescoping member 1602 from rotating beyond a certain point relative to the inner telescoping member 1604 and the removable stub 1702. Consequently, the angular position of the push button 1506 is restricted relative to the removal prevention slots 1606. That is, the rotational position of the push button 1506 is kept to within the opening for the removal prevention slots 1606.

Figures 20A, 20B, 20C:
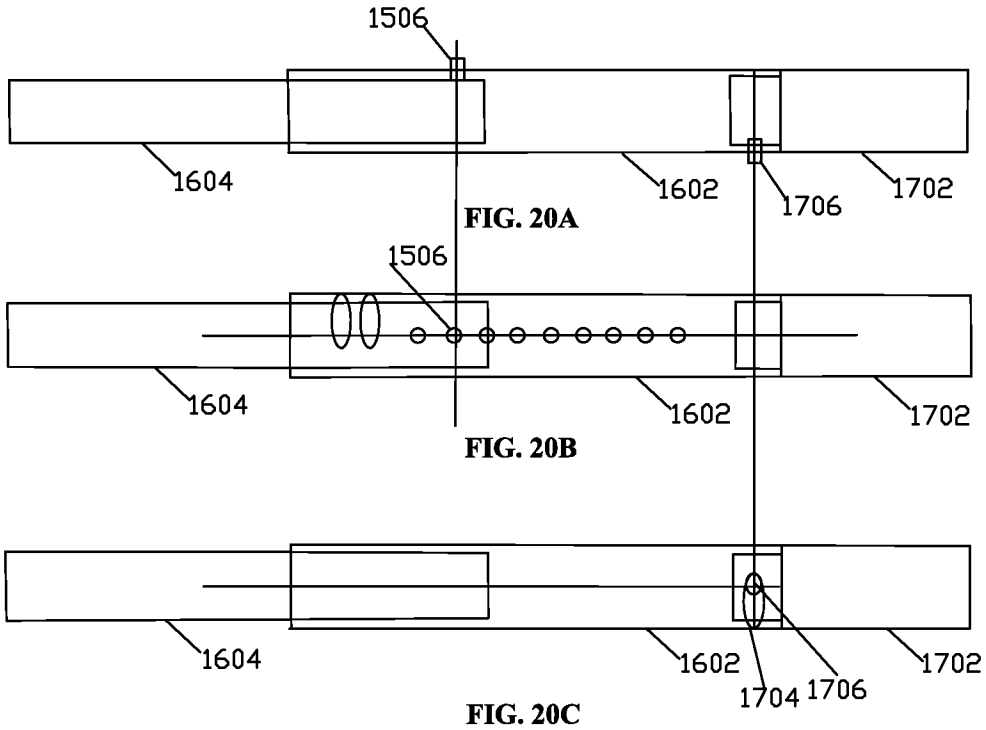
FIGS. 20A-20C illustrate how the components of the angle member fit together according to one example.

FIGS. 20A-20C illustrate how the components of the angle member fit together according to one example. Here the push button 1506 is engaged in one of the holes 1504 and the push button 1706 is engaged within the rotation-limiting slot 1704.

Figures 21A, 21B, 21C:
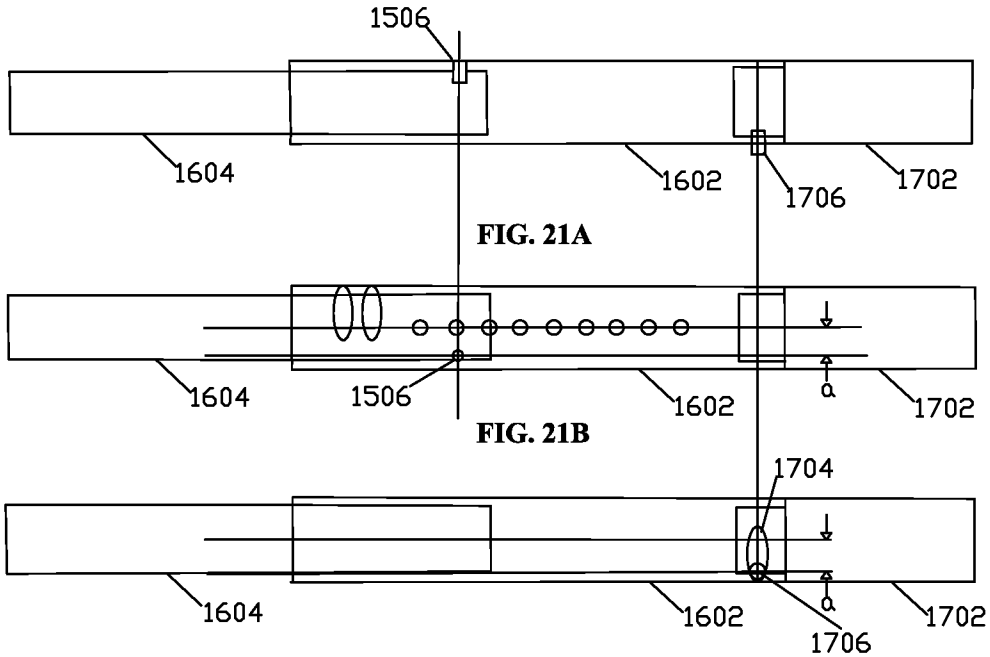
FIGS. 21A-21C illustrate how the push button has been depressed and the outer telescoping member has been rotated relative to the inner telescoping member and the removable stub.

FIGS. 21A-21C illustrate how the push button 1506 has been depressed and the outer telescoping member 1602 has been rotated relative to the inner telescoping member 1604 and the removable stub 1702. The rotation α of the outer telescoping member 1602 is limited by the push button's 1706 rotation within the rotation-limiting slot 1704.

Figures 22A, 22B, 22C:
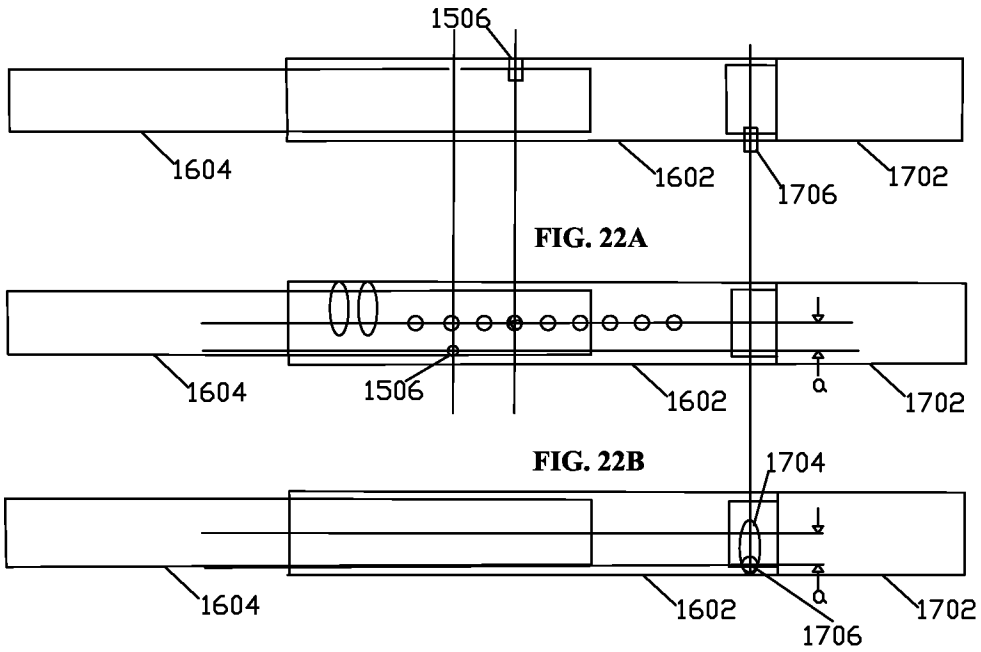
FIGS. 22A-22C illustrate how the inner telescoping member has slid a distance d relative within the outer telescoping member.

FIGS. 22A-22C illustrate how the inner telescoping member 1604 has slid a distance d relative within the outer telescoping member 1604.

Figures 23A, 23B, 23C:
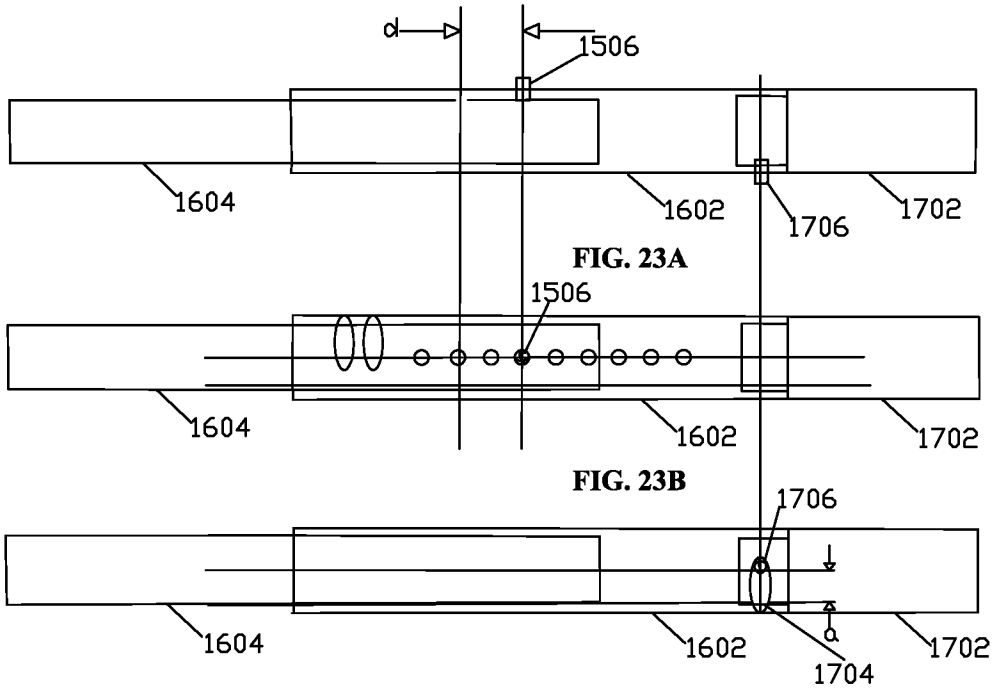
FIGS. 23A-23C illustrate how the inner telescoping member is rotated so that the push button engages the corresponding hole in the outer telescoping member.

FIGS. 23A-23C illustrate how the inner telescoping member 1604 is rotated so that the push button 1506 engages the corresponding hole in the outer telescoping member 1602. Here again, the push button 1706 has rotated back to the first end of the rotation-limiting slot 1704.

In some instances, the examples may have been described for only one member of the throwback device frame, however, it should be understood that the frame may be symmetrical.

Exemplary Throwback Device and Sport Goal Combination

Figure 24:
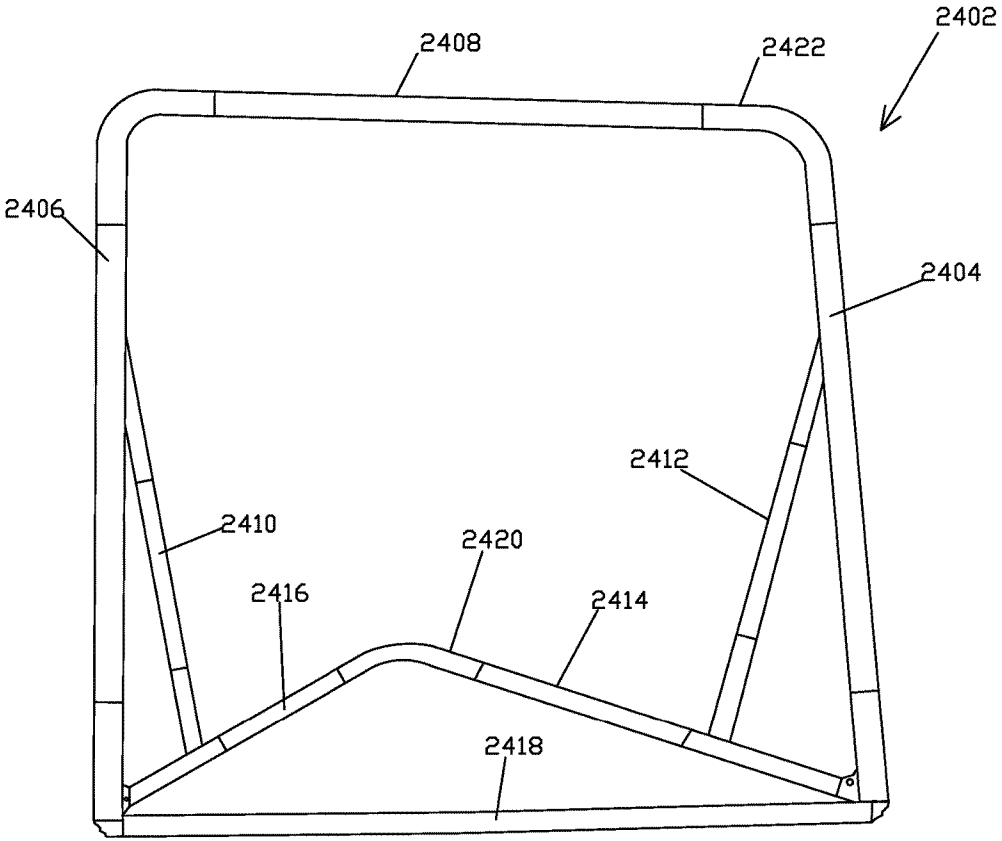
FIG. 24 illustrates a frame for a throwback and sport goal combination device according to one example.

FIG. 24 illustrates a frame for a throwback and sport goal combination device according to one example. The combination device 2402 includes a front frame 2422 that comprises two upright members 2404 and 2406, a top member 2408 coupled to the two upright members 2404 and 2406 at a first end, and a removable bottom member 2418 attached to a second end of the two upright members 2404 and 2406. Additionally, the combination device 2402 may include a base frame 2420 comprising two horizontal members 2414 and 2416. Each horizontal member is attached to an upright member at a first end and to each other at a second end.

The combination device 2402 further includes two angle members 2410 and 2412 that are coupled between the first and second ends of the upright members 2406 and 2404, respectively, and coupled between the first and second ends of the horizontal members 2416 and 2414, respectively. The angle members 2410 and 2412 may be telescoping and allow adjusting of the angle of the front frame 2422 relative to the base frame 2420.

Figure 25:
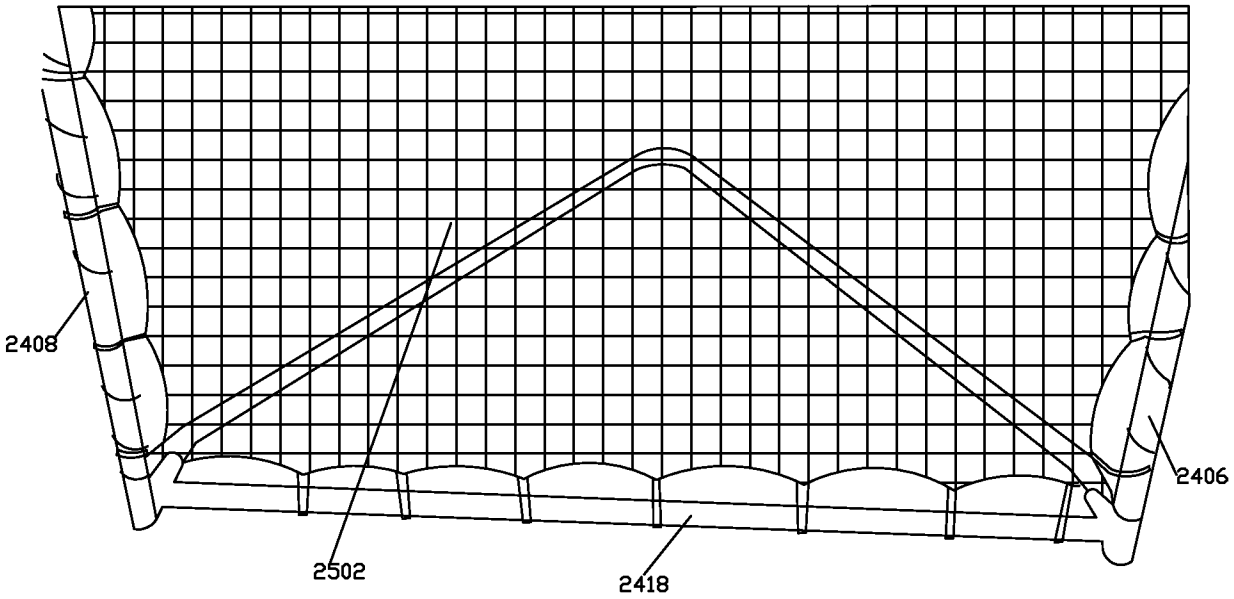
FIG. 25 illustrates how a bounce-back net may be extended between the members of the front frame.
Figure 27:
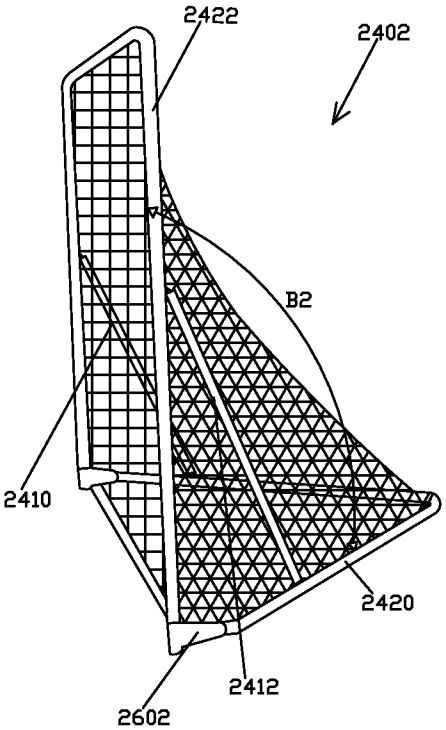
FIGS. 26-30 illustrate how the combination device may be adjusted to various angles.
Figure 26:
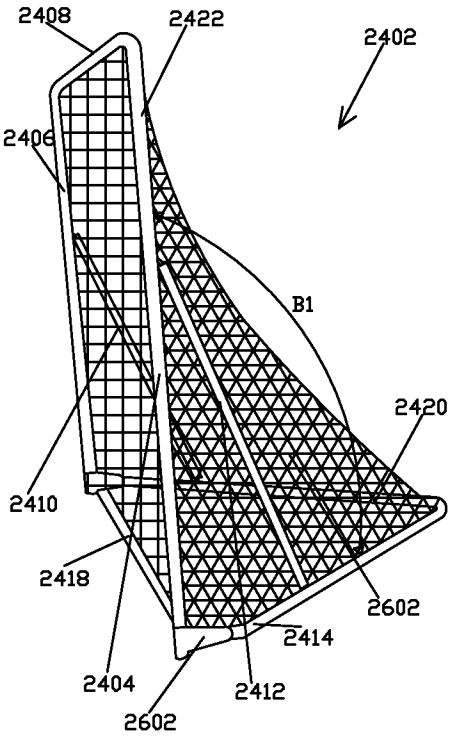
Figure 29:
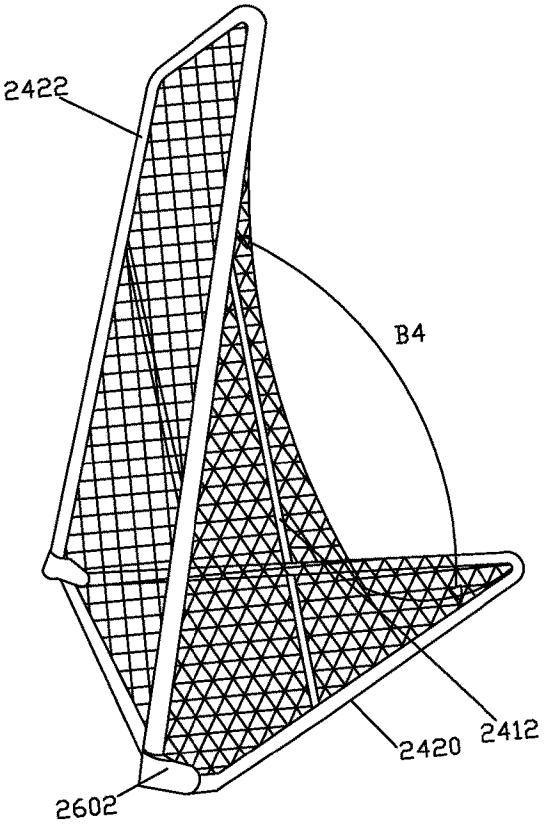
Figure 28:
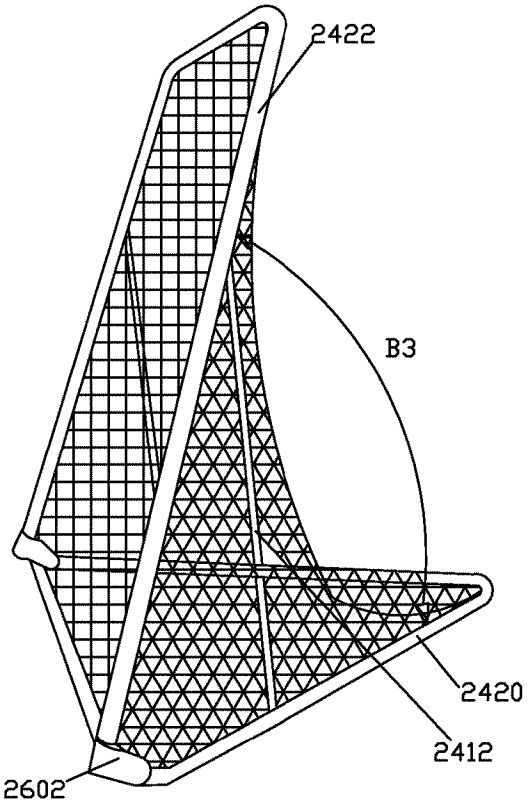
Figure 30:
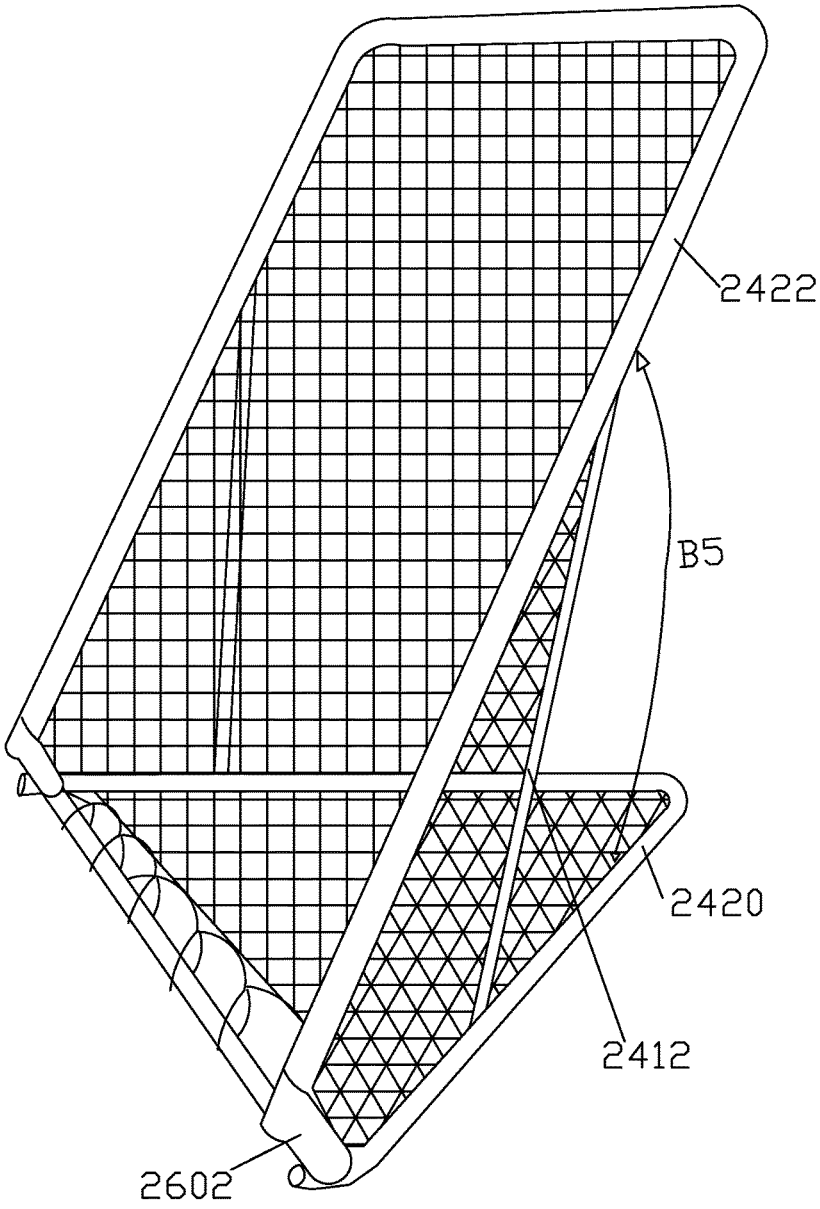
Figures 31, 32:
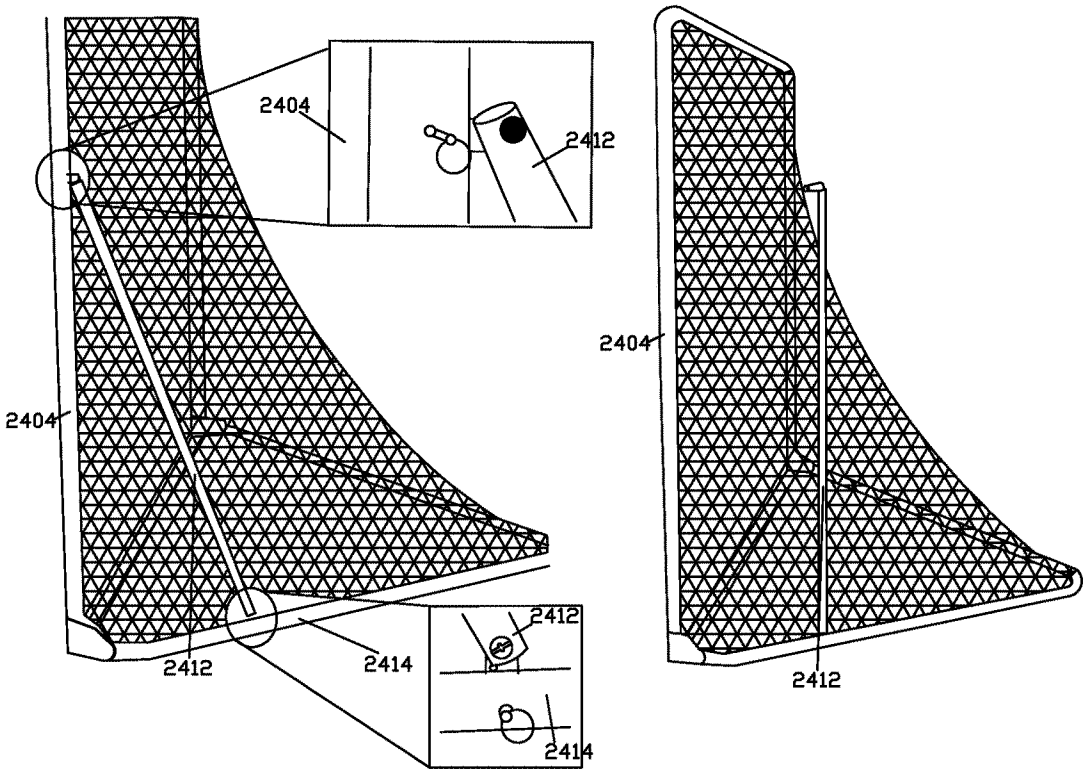
FIGS. 31-36 illustrate how an angle member may be detached from an upright member.
Figure 34:
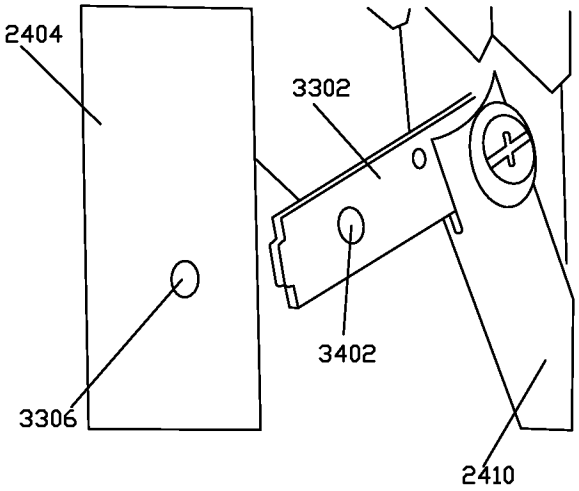
Figure 33:
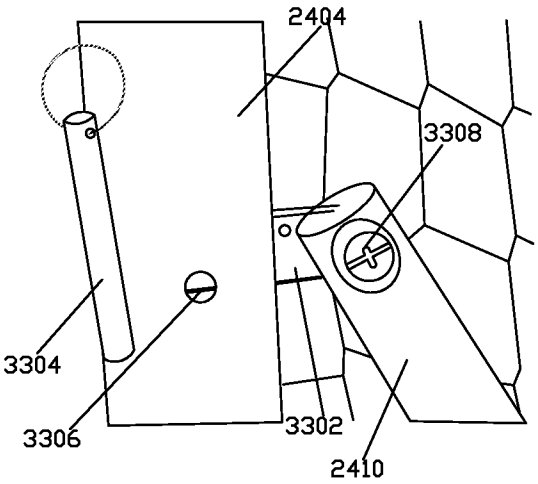
Figure 36:
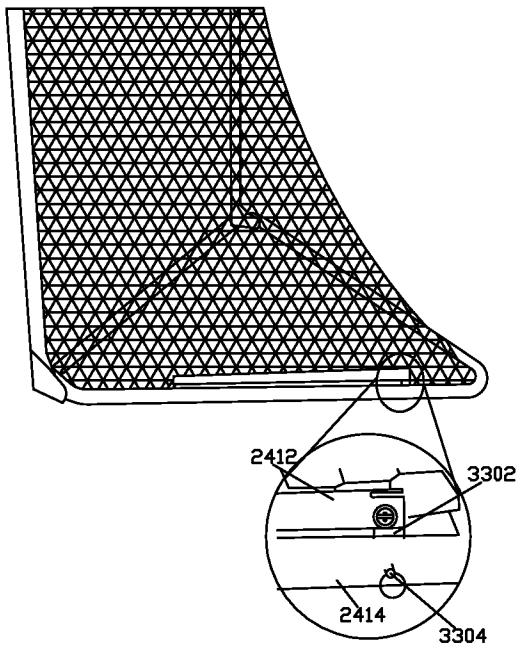
Figure 35:
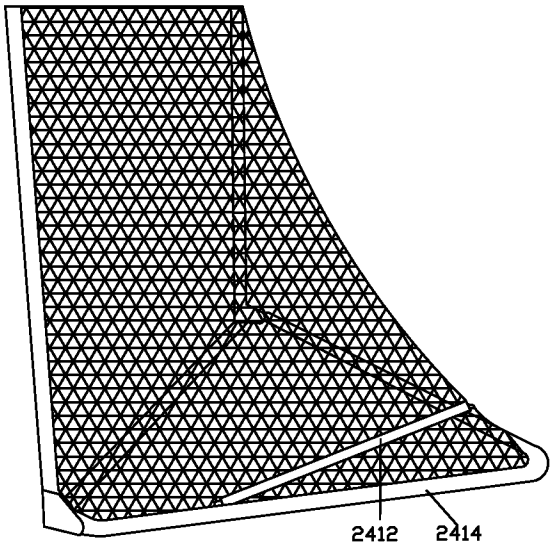
Figure 37:
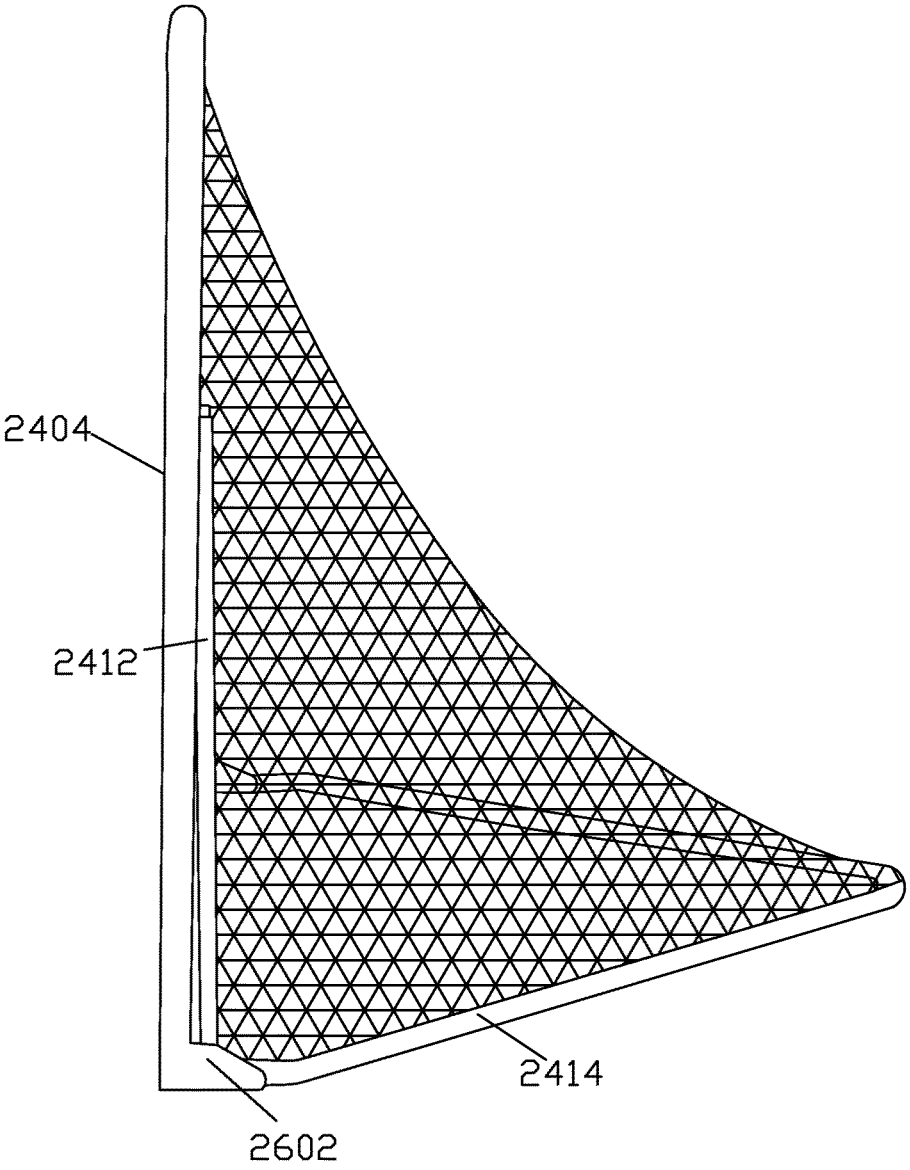
FIGS. 37-40 illustrate an alternative implementation in which the angle member may be detached from a horizontal member.

FIG. 25 illustrates how a bounce-back net 2502 may be extended between the members of the front frame 2422. In this configuration, the bound-back net 2502 may be coupled to each of the front frame 2422 members (e.g., upright members 2404 and 2406, top member 2408, and removable bottom member 2418).

FIGS. 26-30 illustrate how the combination device may be adjusted to various angles. This is possible because the angle members 2412 and 2410 are telescoping (allowing their lengths to be adjusted) and the upright members 2404 and 2406 are coupled to the base frame by hinge brackets 2602. The hinge brackets 2602 allow the front frame 2422 to be angled relative to the base frame 2420. In these examples, the angles between the front frame 2422 and the base frame 2420 are $\beta1>\beta2>\beta3>\beta4>\beta5$.

FIGS. 31-36 illustrate how an angle member 2412 may be detached from an upright member 2404. In some instances, e.g., for storage or to use the combination member as a goal post, it may be desirable to remove the angle members 2412 and 2410 or fold them away. Here the angle member 2412 may be detached from an upright member 2404 by removing a pull pin 3304 that passes through an opening 3306 and a hole 3402 in a securing tab 3302 pivotally attached to the angle member 2412 by a fastener 3308. Note that the upright member 2404 includes a receiving slot through which part of the securing tab 3302 passes. The angle member 2412 can then be removed and folded back so that it lies on the horizontal member 2414. The securing tab 3302 may then be inserted into a receiving slot and secured to the horizontal member 2414 with the pull pin 3304.

Figure 39:
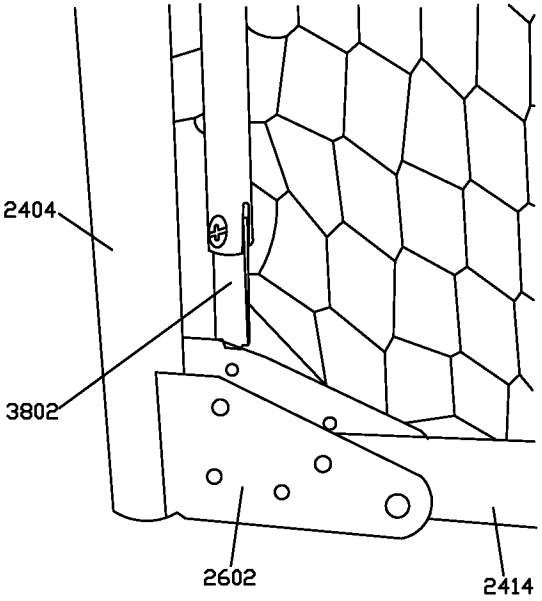
Figure 38:
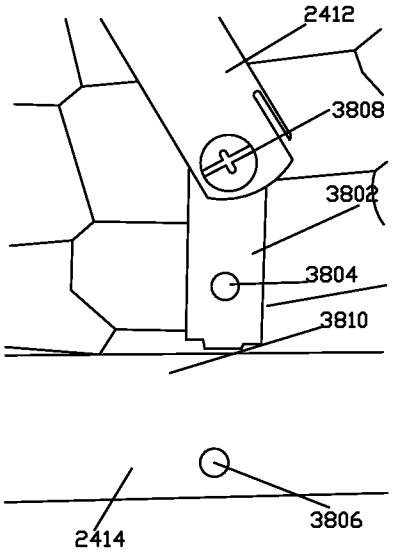
Figure 40:
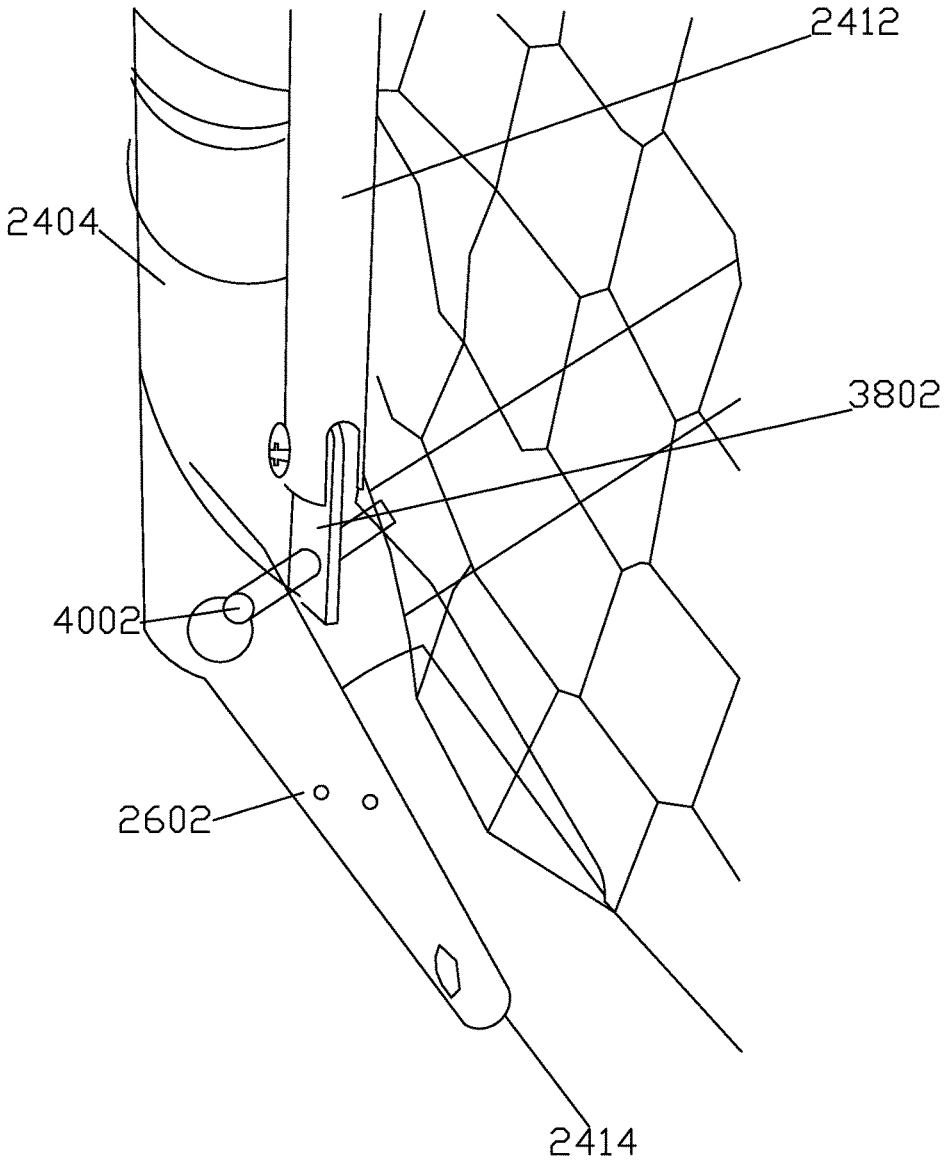
Figure 42:
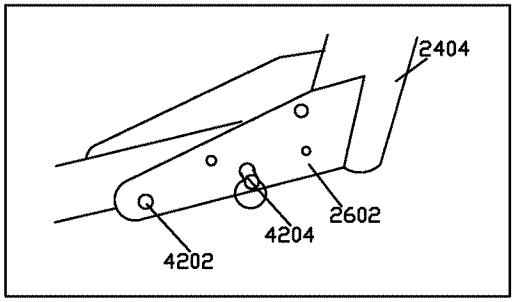
FIGS. 41-46 illustrate the hinge bracket that secures the upright members to the horizontal members and allows folding of the front frame onto the base frame.
Figure 43:
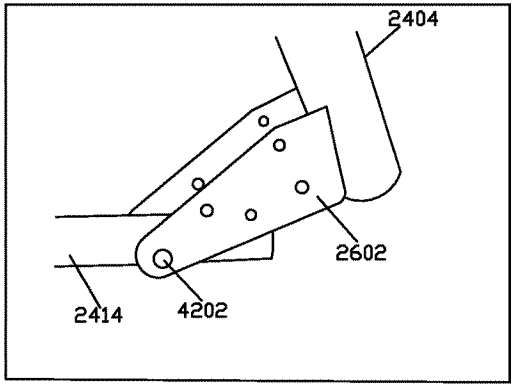
Figure 41:
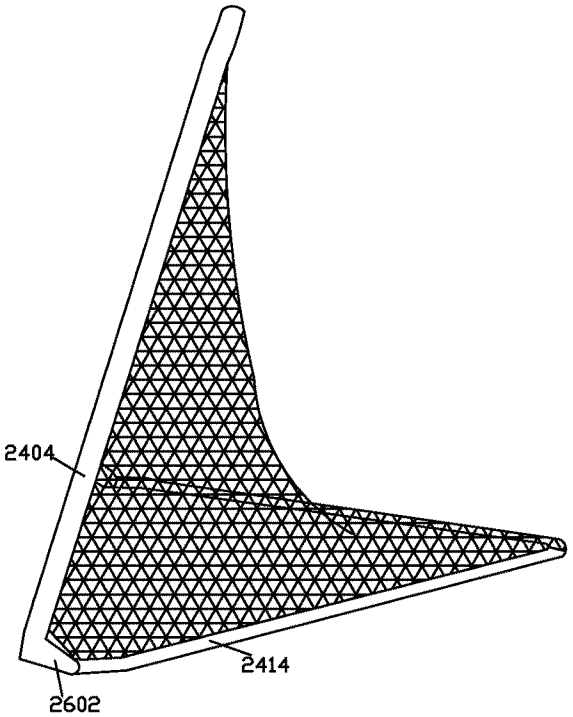
Figure 44:
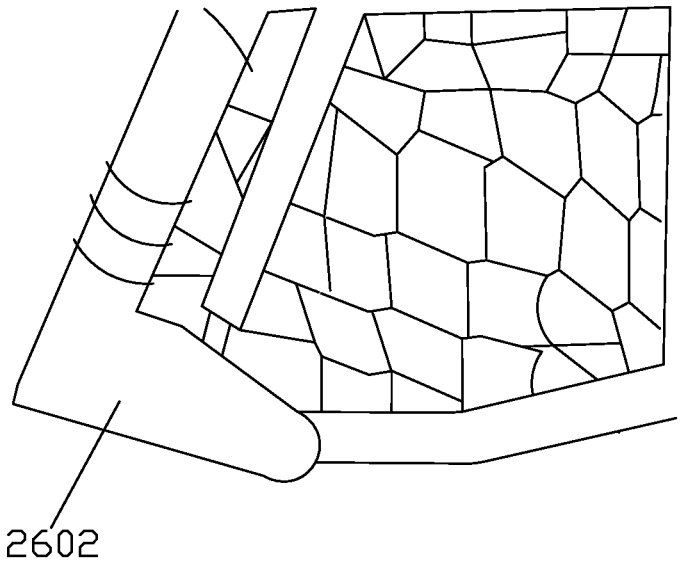
Figure 45:
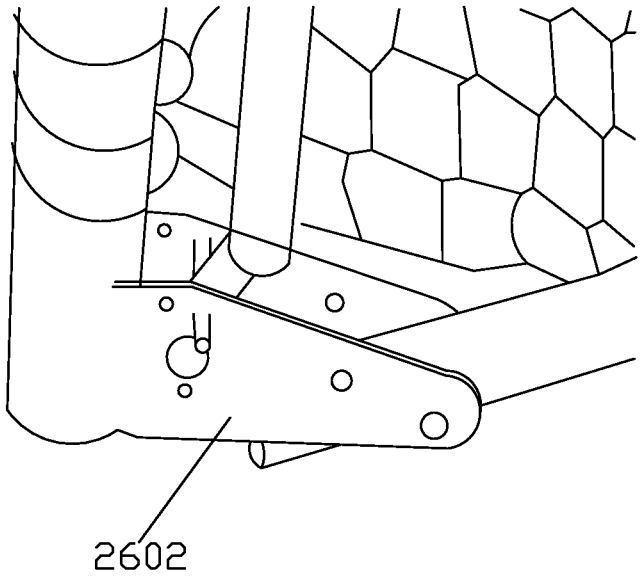

FIGS. 37-40 illustrate an alternative implementation in which the angle member 2412 may be detached from a horizontal member 2414. Here the angle member 2412 may be detached from an horizontal member 2414 by removing a pull pin that passes through an opening 3806 and a hole 3804 in a securing tab 3802 pivotally attached to the angle member 2412 by a fastener 3808. Note that the horizontal member 2414 includes a receiving slot 3810 through which part of the securing tab 3802 passes. The angle member 2412 can then be removed and folded towards the upright member 2404 so that it lies against the upright member 2404. The securing tab 3802 may then be inserted into a receiving slot and secured to the upright member 2404 with a pull pin. Alternatively, as illustrated in FIGS. 39 and 40, the securing tab 3802 may be coupled to the hinge bracket 2602 with a pull pin 4002 passing through a hole in the hinge bracket 2602 and the hole in the securing tab 3802.

Figure 46:
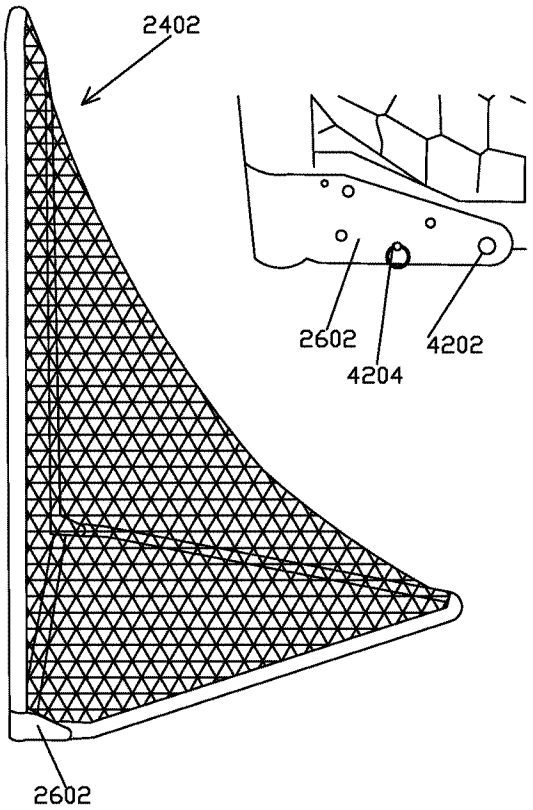

FIGS. 41-46 illustrate the hinge bracket 2602 that secures the upright members 2404 and 2406 to the horizontal members 2414 and 2416, respectively, and allows folding of the front frame 2422 onto the base frame 2420. The hinge bracket 2602 may be fixedly coupled to the upright member 2404 at a first end while pivotally coupled to the horizontal member 2414 at a second end. At the second end, a fastener 4202 may traverse the hinge bracket 2602 and the horizontal member 2414. To keep the front frame 2422 from folding onto the base frame 2420, a pull pin 4204 traverses the hinge bracket 2602 and the horizontal member 2414 in a region between the first and second ends of the hinge bracket 2602. The pull pin 4204 may be used when the front frame 2422 is to be kept at a substantially right angle to the base frame 2420, as illustrated in FIG. 46. When the combination device 2402 is to be used as a throwback device, the front frame 2422 may be angled relative to the base frame 2420 by removal of the pull pin 4204 and the angle members 2410 and 2412 are used to adjust the angle.

Figure 47:
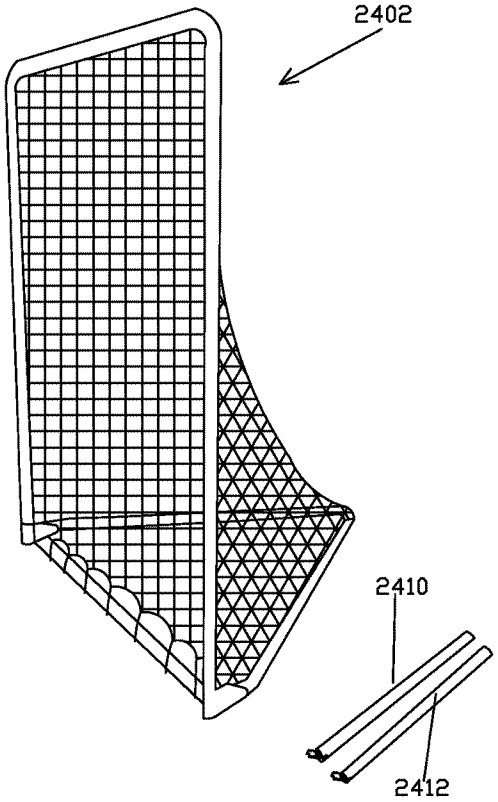
FIG. 47 illustrates how the angle members may be removed from the combination device.

FIG. 47 illustrates how the angle members 2410 and 2412 may be removed from the combination device 2402.

Figure 48:
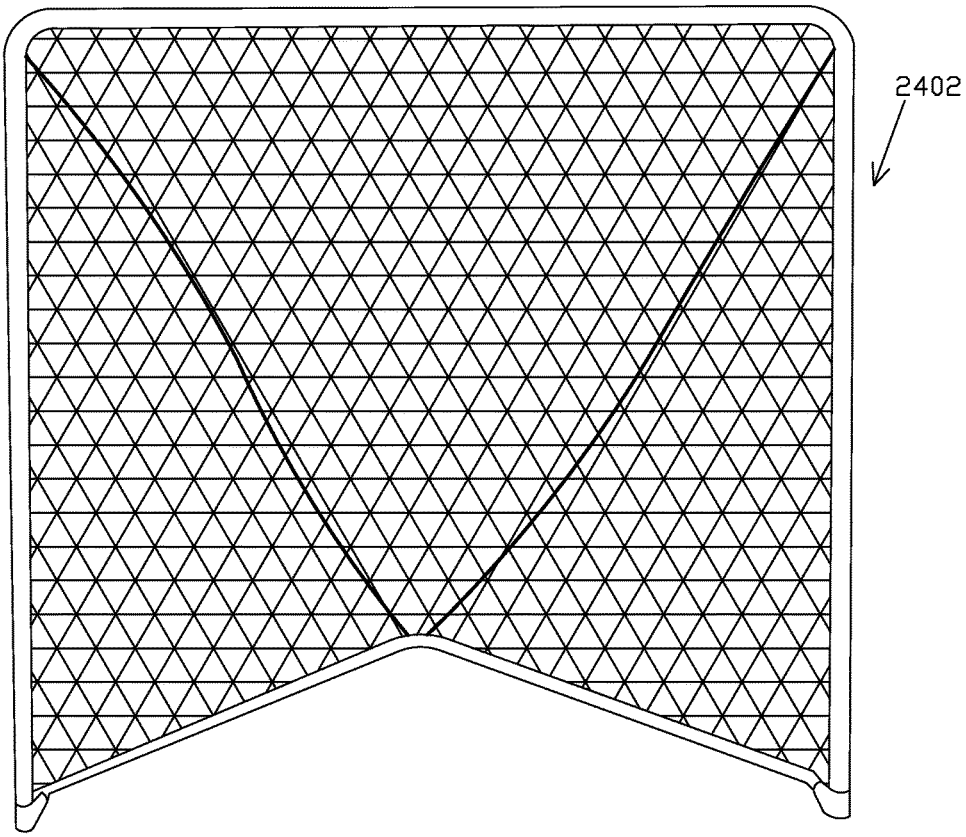
FIG. 48 illustrates how the combination device may be used as a sports goal by removing the bounce-back net and the removable bottom member.

FIG. 48 illustrates how the combination device 2402 may be used as a sports goal by removing the bounce-back net 2502 and the removable bottom member 2418.

Figure 50:
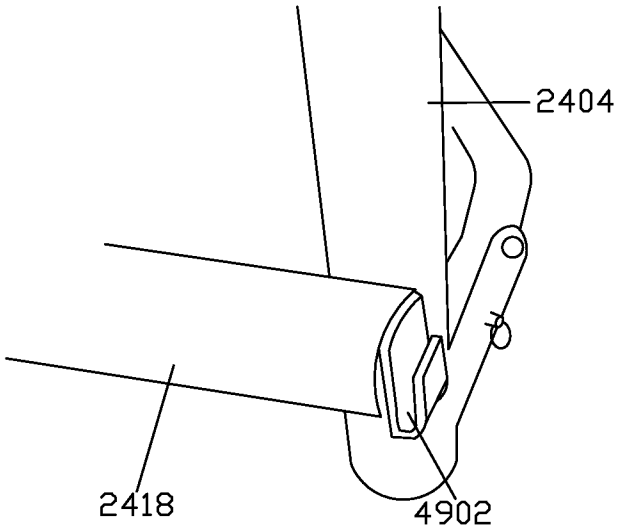
FIGS. 49-50 illustrate how the removable bottom member attaches and detaches from the combination device.
Figure 49:
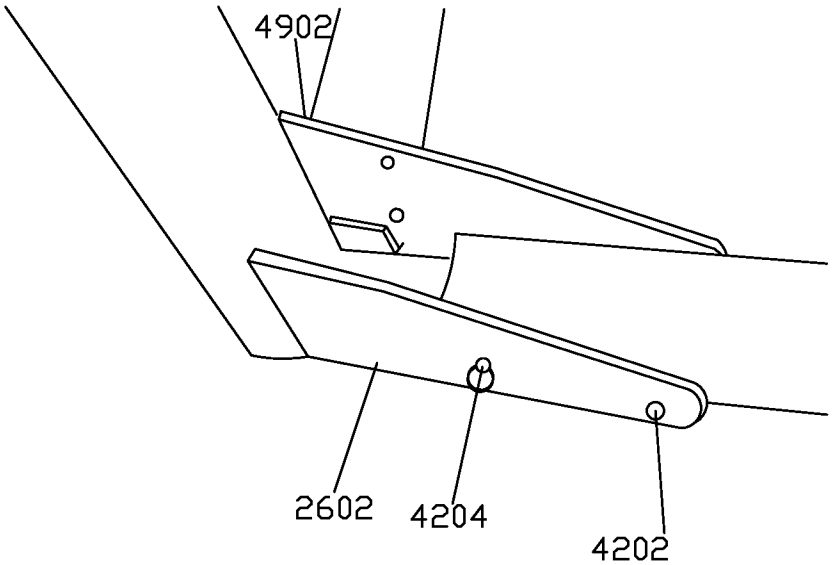

FIGS. 49-50 illustrate how the removable bottom member 2418 attaches and detaches from the combination device 2402. As seen in FIG. 49, the removable bottom member 2418 includes a coupling bracket 4902 that defines a slot through which a wall of the hinge bracket 2602 may fit. To remove the removable bottom member 2418, the coupling bracket 4902 is detached from the hinge bracket 2602 by simply lifting the hinge bracket 2602 so that the coupling bracket 4902 can be pulled off. In alternative embodiments, rather than using the coupling bracket 4902, a stub or pin may be attached to the ends of the removable bottom member 2418 and engage one or more openings or holes in the interior side of the hinge bracket 2602.

Figure 52:
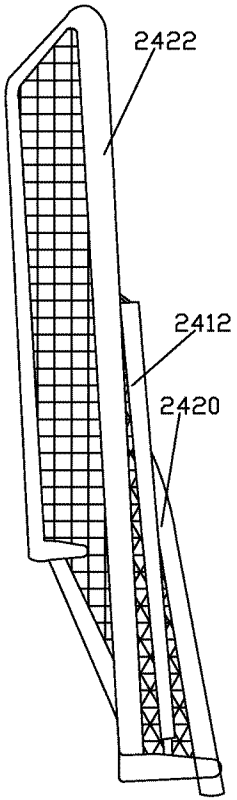
FIGS. 51 and 52 illustrate how the combination device may be folded substantially flat for ease of transportation or storage.
Figure 51:
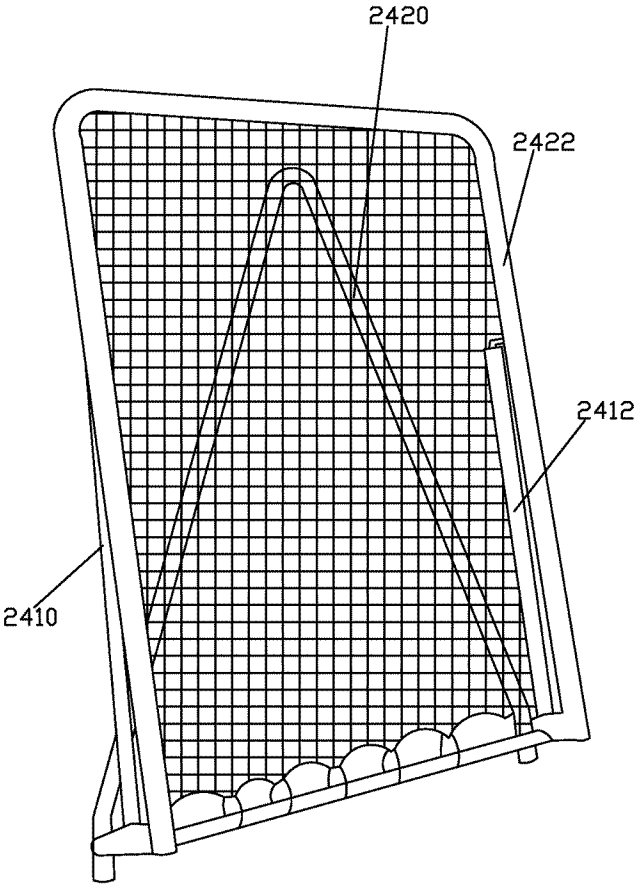

FIGS. 51 and 52 illustrate how the combination device 2402 may be folded substantially flat for ease of transportation or storage. Here the front frame 2422 has been folded against the base frame 2420 with the angle members 2410 and 2412 having been secured against the upright members 2404 and 2406.

Figures 53A, 53B, 53C:
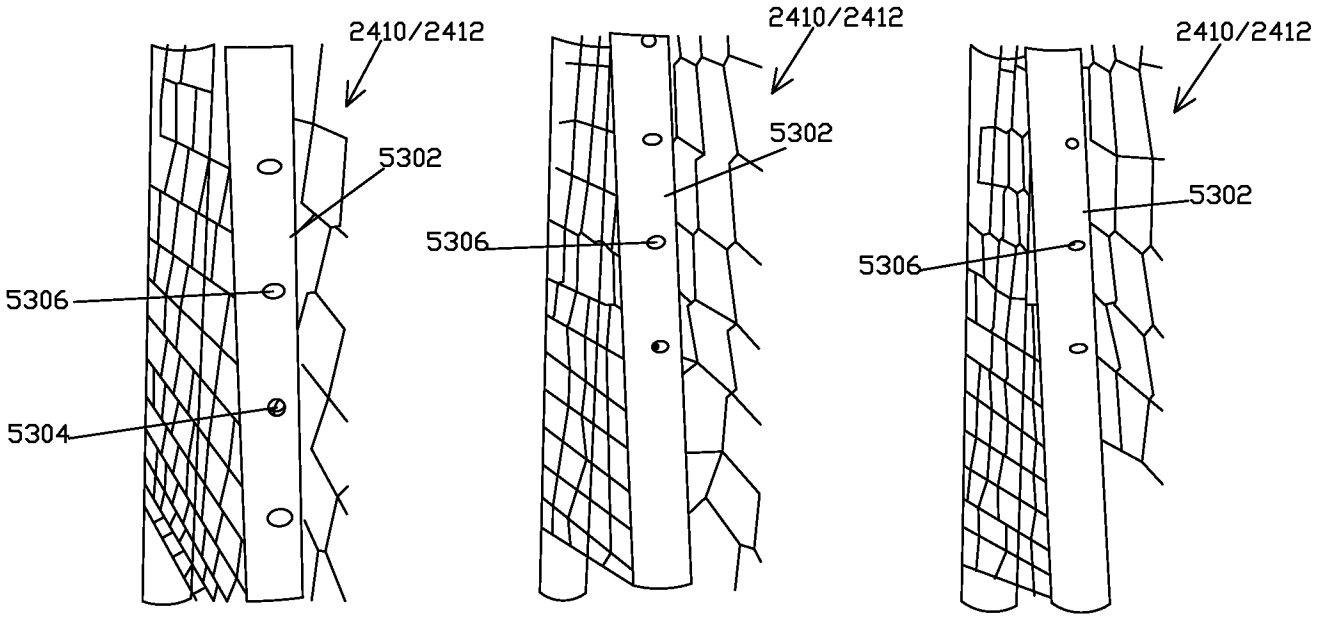
FIGS. 53A-C illustrate how the angle members may be adjusted.
Figure 54:
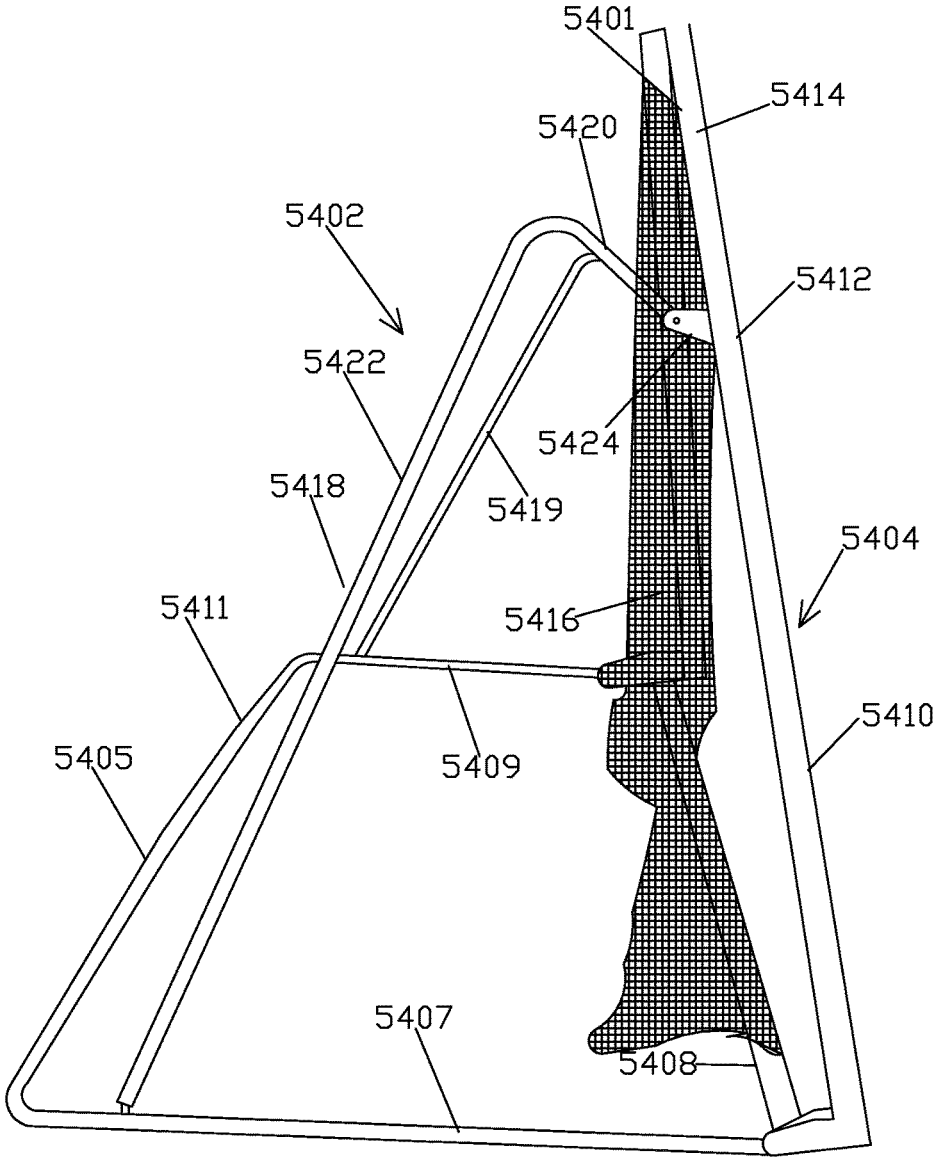
FIGS. 54-58 illustrate an alternative throwback and goal post combination device.
Figure 55:
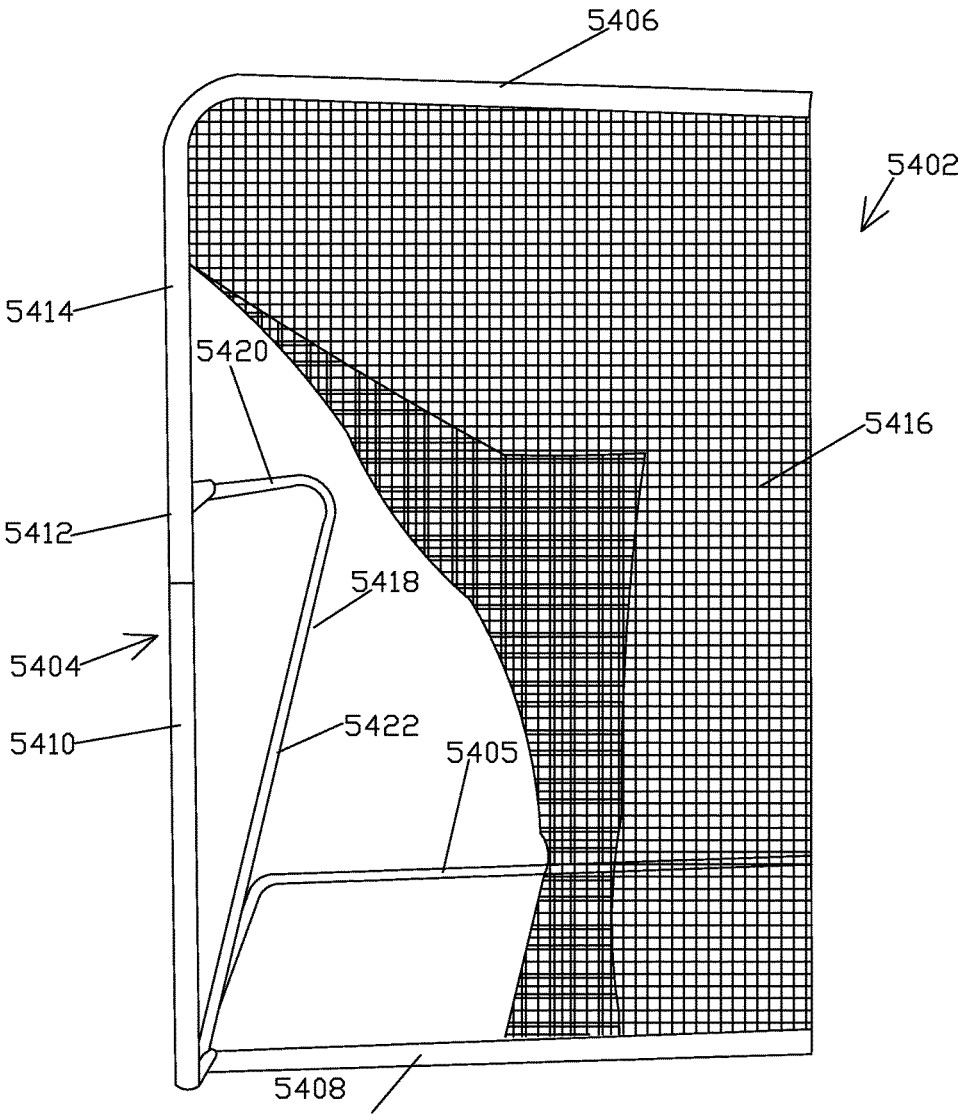
Figure 57:
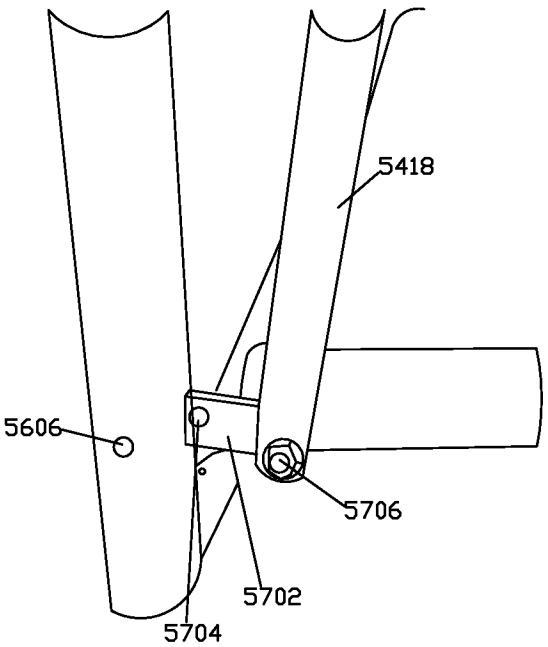
Figure 56:
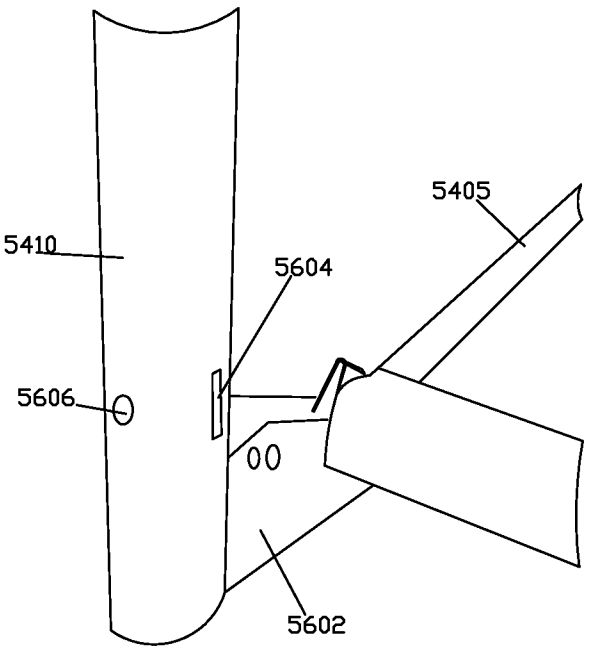
Figure 58:
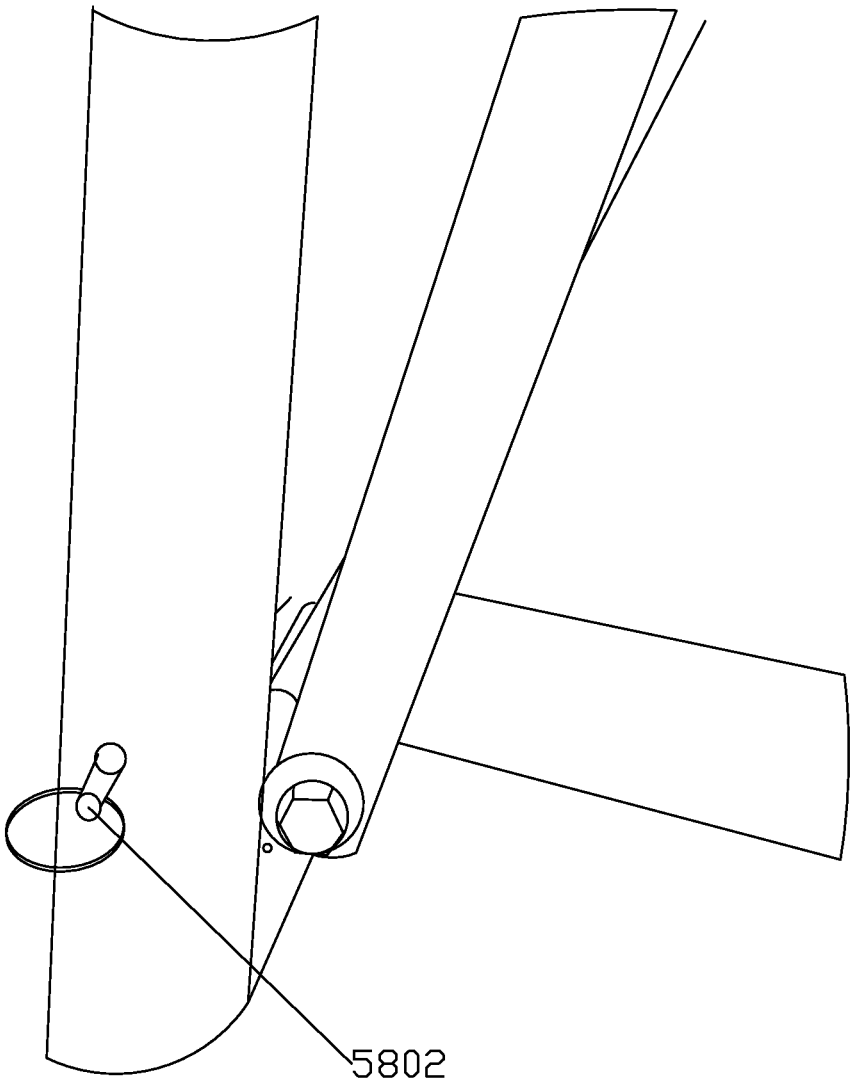

FIGS. 53A-C illustrate how the angle members 2410 and 2412 may be adjusted. The angle members may include a telescoping mechanism that operates as illustrated in FIGS. 19-23. For example, while a first end of the angle member 2412 is coupled to the horizontal member 2414 and the second end of the angle member 2412 is coupled to the upright member 2404, an outer segment 5302 can be rotated relative to both ends. The outer segment 5302 may then be extended or retracted relative to an inner segment that slides inside the outer segment 5302 in a telescoping fashion. The inner segment may include a push button 5304 that can be depressed so disengage from one of a plurality of holes 5306 aligned in a row along the length of the outer segment 5302. As illustrated in FIGS. 53A-C, the outer segment 5302 can be turned in a first direction so that the push button 5304 does not align with the holes 5306 while the length of the angle member 2410/2412 is increased or decreased. Once the desired length has been achieved, the outer segment 5302 can be twisted in an opposite second direction so that the push button 5304 again aligns with the holes 5306 and the outer segment 5302 can be fixed to the inner segment. As described with reference to FIGS. 19-23 a rotation limiting mechanism may be employed to prevent the over-rotation of the outer segment 5302 and to prevent the inner segment from becoming unintentionally disengaged from the outer segment 5302.

FIGS. 54-58 illustrate an alternative throwback and goal post combination device. The combination device 5402 includes a front frame 5401 coupled to a base frame 5405. The front frame 5401 includes two upright members, a top horizontal member 5406 (FIG. 55) and a bottom horizontal member 5408. Each upright member 5404 includes a first segment 5410, a second segment 5412, and a third segment 5414. The base frame 5405 includes two horizontal feet 5407 and 5409 and a rear transverse member 5411. Angle members 5418 and 5419 are coupled to either side between the front frame 5401 and the base frame 5405. For example, the angle member 5418 may be coupled to a bracket 5424 attached to the second segment 5412, where the second segment 5412 rotates relative to the first segment 5410 and third segment 5414. The angle member 5418 may include a first section 5420 at a substantially right angle to a second section 5422. In other implementations, the angle between the first section 5420 and the second section 5422 may be less than ninety degrees. The angle members 5418 and 5419 may serve to provide support between the upright member 5404 and the horizontal foot 5407. Additionally, the second section 5422 may be telescoping so that its length can be increased or decreased, thereby allowing adjustment of the angle between the front frame 5401 and the base frame 5405.

In one example, when used as a throwback device, a net 5416 may stretch between the members of the front frame. When used as a sport goal, the net 5416 may be attached to the top horizontal member 5406 and extends to the rear transverse member 5411, the angle members 5418 and 5419 providing support for the net 5416.

To fold the combination device 5402 into a substantially flat package, the angle members 5418 and 5419 may be detached from the horizontal feet 5407 and 5409, respectively. The angle member 5418 may then be rotated inward, thereby causing the second segment 5412 to rotate inward as well. The first segment 5410 may be coupled to a hinge bracket 5602 which is attached to the base frame 5405. The first segment 5410 may also include a slot 5604 and an opening 5606. A securing tab 5702 is attached to the detached end of the angle member 5418 by a fastener 5706. This is the same securing tab that was used to couple the angle member 5418 to the horizontal foot 5407. The securing tab 5702 is inserted into the slot 5604 and fastened with a pull pin 5802 inserted through the opening 5606 and a corresponding opening 5704. In this manner, the angle members 5418 and 5419 can be folded into the thickness of the front frame 5401. The base frame 5405 can then be folded toward the front frame 5401 to allow for storage and transportation of the combination device 5402.

In some instances, the examples may have been described for only one member of the combination device, however, it should be understood that the frame of the combination device may be symmetrical.

As used throughout this specification, the terms "push button" and "pull pin" have been used to indicate a fastener. It should be understood that other fasteners such as pins, screws, etc. may also be used.

While certain exemplary embodiments have been described and shown in the accompanying drawings, it is to be understood that such embodiments are merely illustrative of and not restrictive on the broad invention, and that this invention is not to be limited to the specific constructions and arrangements shown and described, since various other modifications may occur to those ordinarily skilled in the art.

What is claimed is:

1. A foldable throwback device, comprising:

a front frame adapted to secure a bounce-back surface, the front frame foldable into at least two sections without removal of the bounce-back surface;

a base frame coupled to the front frame by hinge brackets that allow the base frame to fold onto the front frame, the front frame does not extend beyond the base frame, the base frame including two horizontal feet and a transverse foot, each horizontal foot coupled to the front frame by a hinge bracket at a first end and to the transverse foot at a second end; and first and second telescoping angle members, each angle member extending from the base frame to the front frame such that each angle member does not extend beyond the base frame, each angle member including an outer and an inner telescoping member, the first and second telescoping angle members adjustable to allow angling the front frame relative to the base frame, wherein the front frame includes two upright members, each upright member having an upper end, a lower end and at least one hinge located between the upper and the lower end that allows the front frame to fold into at least two sections and allows each angle member to couple to each upright member by the at least one hinge of each upright member to allow angling the front frame relative to the base frame, wherein the front frame includes an upper horizontal member and a lower horizontal member secured to the two upright members, the upper horizontal member secured to each upper end of the two upright members and the lower horizontal member secured to the two upright members at a position between the each upper end and each lower end of the two upright members and wherein the lower horizontal member is not in contact with the base frame and the bounce-back surface overlaps the lower horizontal member, wherein at least one of the outer or inner telescoping member includes a plurality of openings along at least a portion of its length, and a push button or pin engages one of the openings to secure the inner telescoping member to the outer telescoping member, wherein the base frame is secured to the each upright member at the each lower end, and wherein the two horizontal feet and the transverse foot of the base frame are in contact with a surface or ground.

2. The foldable throwback device of claim 1, wherein the front frame is adapted to lift from the ground when the hinge brackets pivot to tilt the bounce-back surface.

3. The foldable throwback device of claim 1, wherein each of the telescoping angle members further includes a stub, the stub coupled to the front frame, the inner telescoping member coupled to the base frame, and the outer telescoping member rotates relative to the stub and inner telescoping member to change the length of the angle member.

4. The foldable throwback device of claim 1, wherein the first and second telescoping angle members are detachable from the base frame and attachable to their respective hinge bracket, the base frame is then foldable toward the front frame to make the foldable throwback device substantially flat.

5. The foldable throwback device of claim 1, wherein the outer telescoping member includes at least one safety slot at a second end to prevent the inner telescoping member from becoming disengaged, the safety slot sized to catch the push button whether the outer telescoping member is rotated or not.

6. The foldable throwback device of claim 1, wherein the front frame is foldable while the bounce-back surface is under tension.

7. The foldable throwback device of claim 1, wherein the bounce-back surface is secured on all sides of the front frame by a plurality of spring fasteners.

8. The foldable throwback device of claim 1, wherein the first and second telescoping angle members are folded between at least two sections of the front frame.

9. The foldable throwback device of claim 1, wherein the outer telescoping member is rotatable relative to the inner telescoping member to change the length of the angle member, and a stub that includes a pin engages a rotation-limiting slot at a first end of the outer telescoping member to limit the rotation of the outer telescoping member relative to the inner telescoping member.

10. The foldable throwback device of claim 1, wherein the bounce-back surface covers at least 80% of the area defined by the front frame.

11. A foldable throwback device, comprising:

a front frame adapted to secure a bounce-back surface, the front frame foldable into at least two sections without removal of the bounce-back surface, wherein the front frame includes upright members, each upright member includes an upper end, a lower end and at least a first and second segment;

a base frame coupled to the front frame by hinge brackets that allow the base frame to fold onto the front frame, the front frame does not extend beyond the base frame, the base frame including two horizontal feet and a transverse foot, each horizontal foot coupled to the front frame by a hinge bracket at a first end and to the transverse foot at a second end, wherein the base frame is secured to the upright members at each lower end, and wherein the two horizontal feet and the transverse foot of the base frame are in contact with a surface or ground;

first and second angle members, each angle member extending from the base frame to the front frame such that each angle member does not extend beyond the base frame, the angle members comprising at least a first section and a second section, each of the first and second angle members coupled to the second segment in a corresponding upright member to allow angling the front frame relative to the base frame, the second segment is rotational relative to the first segment, wherein the front frame includes an upper horizontal member and a lower horizontal member secured to the upright members, the upper horizontal member secured to each upper end of the upright members and the lower horizontal member secured to the upright members at a position between the each upper end and each lower end of the upright members and wherein the lower horizontal member is not in contact with the base frame and the bounce-back surface overlaps the lower horizontal member.

12. The foldable throwback device of claim 11, wherein the front frame is adapted to lift from the ground when the hinge brackets pivot to tilt the bounce-back surface.

* * * * *